US009767624B2

(12) United States Patent
Bakfan et al.

(10) Patent No.: US 9,767,624 B2
(45) Date of Patent: Sep. 19, 2017

(54) METHOD AND SYSTEM FOR RETRIEVING VEHICULAR PARAMETERS FROM A VEHICLE DATA BUS

(71) Applicant: ORPAK SYSTEMS LTD, Bnei Brak (IL)

(72) Inventors: Shay Bakfan, Netanya (IL); Hezi Manos, Givatayim (IL); Itay Peri, Alfe-Menashe (IL); Osnat Neulander, Kfar Saba (IL)

(73) Assignee: Orpak Systems Ltd, Bnei Brak (IL)

( * ) Notice: Subject to any disclaimer, the term of this patent is extended or adjusted under 35 U.S.C. 154(b) by 0 days.

(21) Appl. No.: 14/654,579

(22) PCT Filed: Dec. 23, 2013

(86) PCT No.: PCT/IL2013/051057
§ 371 (c)(1),
(2) Date: Jul. 30, 2015

(87) PCT Pub. No.: WO2014/097305
PCT Pub. Date: Jun. 26, 2014

(65) Prior Publication Data

US 2015/0371457 A1 Dec. 24, 2015

Related U.S. Application Data

(60) Provisional application No. 61/745,609, filed on Dec. 23, 2012.

(51) Int. Cl.
*G07C 5/00* (2006.01)
*G07C 5/08* (2006.01)

(52) U.S. Cl.
CPC ..... *G07C 5/008* (2013.01); *G07C 5/0841* (2013.01)

(58) Field of Classification Search
CPC ..... G08G 1/20; G07C 5/008; G07C 5/0841
See application file for complete search history.

(56) References Cited

U.S. PATENT DOCUMENTS 5,835,740 A * 11/1998 Wise ..... G06F 9/3867 375/E7.093
6,367,033 B1 * 4/2002 Jibbe ..... G06F 11/3414 714/37
7,010,397 B1 * 3/2006 Pfleging ..... G08G 1/096725 340/691.6
9,026,304 B2 * 5/2015 Olsen, III ..... G06Q 10/06 701/29.3

(Continued)

FOREIGN PATENT DOCUMENTS

JP 2005042656 A * 2/2005
JP 2005056441 A * 3/2005
JP 2007008422 A * 1/2007 ..... B60W 30/20

OTHER PUBLICATIONS

Hao et al., "A Storage-Friendly Routing Scheme in Intermittently Connected Mobile Network," Year: 2011, vol. 60, pp. 1138-1149.*

*Primary Examiner* — Tuan C. To
(74) *Attorney, Agent, or Firm* — The Law Office of Joseph L. Felber

(57) ABSTRACT

The present invention relates to a device, system and a method for obtaining and monitoring vehicular parameters and in particular, to such a device, system and method in which vehicular parameters are sniffed and automatically ascertained from a vehicle controller data bus.

25 Claims, 11 Drawing Sheets

(56) References Cited

U.S. PATENT DOCUMENTS

| | | | | |
|---|---|---|---|---|
| 2003/0222982 | A1* | 12/2003 | Hamdan | H04N 7/181 348/148 |
| 2005/0276261 | A1* | 12/2005 | Kim | H04L 5/1438 370/389 |
| 2006/0145537 | A1* | 7/2006 | Escott | B60R 11/02 307/10.1 |
| 2008/0086582 | A1* | 4/2008 | Park | G06F 13/4018 710/305 |
| 2008/0189016 | A1* | 8/2008 | Bernzen | B60R 21/013 701/46 |
| 2008/0204357 | A1* | 8/2008 | Azulai | H04L 65/4092 345/2.2 |
| 2008/0316052 | A1* | 12/2008 | Ruffini | H04W 28/18 340/901 |
| 2009/0271127 | A1* | 10/2009 | Tsang | G07C 5/0816 702/34 |
| 2009/0319341 | A1* | 12/2009 | Berkobin | G06Q 30/02 701/36 |
| 2011/0202554 | A1* | 8/2011 | Powilleit | H04L 41/06 707/769 |
| 2012/0004804 | A1* | 1/2012 | Beams | G01S 5/0027 701/32.7 |
| 2014/0001868 | A1* | 1/2014 | Frampton | H02P 9/02 307/80 |
| 2014/0114499 | A1* | 4/2014 | Perner | H04W 4/12 701/2 |
| 2014/0226010 | A1* | 8/2014 | Molin | G06Q 10/06 348/148 |
| 2014/0327533 | A1* | 11/2014 | Ueda | B60K 35/00 340/438 |
| 2016/0005242 | A1* | 1/2016 | Hua | G06F 11/00 701/29.3 |

* cited by examiner

METHOD AND SYSTEM FOR RETRIEVING VEHICULAR PARAMETERS FROM A VEHICLE DATA BUS

RELATED APPLICATIONS

This Application is a national phase of, and claims priority from, PCT Application No. PCT/IL2013/051057, filed on Dec. 23, 2013, which claims priority from U.S. Provisional Application No. 61/745,609, filed Dec. 23, 2012, which is hereby incorporated by reference if fully set forth herein.

FIELD OF THE INVENTION

The present invention relates to a device, system and a method for obtaining and monitoring vehicular parameters and in particular, to such a device, system and method in which vehicular parameters are sniffed and automatically ascertained from a vehicle controller data bus.

BACKGROUND OF THE INVENTION

Vehicles such as cars and trucks, SUVs have an onboard computer and/or controller that is utilized to control and monitor the vehicle's operation. The controller provides for monitoring various operational features and functions related to the vehicle for example communicating with sensors to obtain data, identifying faults, facilitating identifying repair.

The vehicle controller communicates vehicular data available primarily for the vehicle service industry to facilitate detection, identification and repair of vehicle faults. Vehicular data is communicated by the vehicle's central controller and/or processor and/or computer in the form of a message over a Vehicle Data Bus ('VDB').

Generally sensors information and the like vehicular operational data is communicated over a standardized communications system between the on-board engine controller and an off-board tool or monitoring device, using various defined protocols including but not limited to ISO-15031; Controller Area Network (CAN); OBD II; J1939 truck standard; ISO 9041 (K-line), or the like vehicular protocol.

Generally the vehicular data is communicated in the form of messages, however, the message format, as example of which may be seen in FIG. 1, and the vehicular data contained within the message is not standardized and greatly varies between manufacturers and vehicle models.

Most messages produced by vehicle's processor, for example as depicted in FIG. 1, generally comprise a header 12, a data payload 14, and checksum and/or End Of File (EOF) indicator 16. The header 12 generally comprises a unique Message ID field ('MID'), the byte length of the payload. Some messages further comprise a "prefix" field within the payload that is indicative of what data type is contained within the message. However, the prefix is not a standardized indicator where a message may contain a plurality of prefixes, each prefix may be of variable size and location within the message.

The payload itself may comprise data of at least one or more parameters and/or a plurality of different parameters. The parameters communicated within the messages generally take the form of Industry Standard Parameters ('ISP') or Manufacturer Specific Parameters ('MSP'). Generally, ISP parameters are made available by the interrogation process as they are governed by industry standards and legislation. Non-ISP parameters are not governed by legislation and therefore are not necessarily made available by the manufactures, and may be provided in the form of MSP, that are not readily discoverable and/or available.

The vehicular data made available via the communicated messages may be accessed by external systems and/or resources by interrogating the vehicle on board controller for the data in a question and answer process. The question and answer processes requires that the interrogating (asking) device request specific data from the vehicle's controller. Generally the interrogating device is a servicing device utilized for diagnosing the vehicle.

The interrogation and iterative process with the vehicle data bus (VDB) and its associated communication protocols is limited in that it is primarily reserved for facilitating access to vehicular data while the vehicle is not fully operational. For example, while the vehicle being serviced and not while the vehicle is "in full use" and "on-the-road" and/or "on the job".

SUMMARY OF THE INVENTION

The background art is limited in that it attempts to obtain vehicular data while the vehicle is operational by way of interrogating the vehicles on board processor. Accessing vehicular data by interrogation process of the vehicle's controller, while the vehicle is fully operational, is problematic and could lead to unpredictable behavior of the vehicle's central on-board processor, for example unexpected engine failures during use. Furthermore, each interrogation and data request from the vehicle's computer, for example by an external diagnostic device is likely to disturb the operation of the vehicle and/or significantly delay the response time to the parameter request.

The background art is further limited in that the vehicular data is only made available by way of interrogation with the vehicle's on board processor as the vehicle bus communicates the parameters within messages that is compiled in a manner that is specific to the manufacturer and/or vehicle model. Without the interrogation process background art device cannot determine the sought after vehicular data, as the data may not be readily deciphered from within the message payload.

Embodiments of the present invention overcome the deficiencies of the background by providing a device, system and method for accessing and making vehicular data available to an external processor and/or vehicular data management system, without interrogating the vehicle's on board processor while the vehicle is fully operational.

Embodiments of the present invention provide for attaining vehicular parameters available through vehicle's central processor via the vehicle data bus by way of sniffing and/or listing to the vehicle data bus and not interrupting it.

Embodiments of the present invention provide a device capable of reading and/or sniffing the vehicle data bus without interrogating the vehicle's central processor, process the data communicated over the vehicle data bus to abstract and/or attain the vehicular parameters, and to communicate the attained vehicular parameters to a data management system external to the vehicle.

Embodiments of the present invention provide a system comprising a device capable of reading and/or sniffing the vehicle data bus without interrogating the vehicle's central processor in communication with a data management system external to the vehicle. Optionally the data management system may be provided in optional forms for example including but not limited to a server, computer, mobile communication device, mobile computer, network, data processing center, fleet management system, vehicle manufacturer system, legislation and government systems, tracking systems, insurance provider systems, security systems, policing systems, the like or any combination thereof.

Embodiments of the present invention provide a method for attaining vehicular parameters and/or data from the vehicle's data bus without interrogating the vehicle's central processor, the method comprising: obtaining data communicated over the vehicle data bus and implementing a processor mediated data processing technique adapted to identify and/or ascertain vehicular data and/or parameters.

An optional embodiments of the present provides a method for identifying required parameters of a vehicle by sniffing for vehicle bus messages transferred via an OBD port of the vehicle, the method comprising: sniffing to OBD messages transferred over the OBD port; obtaining a plurality of the transferred OBD messages; sorting the obtained OBD messages into a plurality of groups according to the message identification (MID); dividing each group of the sorted OBD messages to one or more suspected vectors wherein each suspected vector (SV) is associated with a segment of an OBD message wherein the values of the segment changes in time; analyzing the changes in time of each of the SVs in order to learn the time behavior of each of the SV; comparing the time behavior of the SVs to expected time behavior of at least one required parameter in order to identify an SV that represents the at least one required parameter; defining a parameter identification information (PID) for the at least one identified required parameter; storing at a memory device the defined PID.

Optionally, the parameters of the vehicle are fleet-management parameters.

Optionally, the time behavior of an SV reflects changes in time of the values of that SV.

Optionally, the OBD port is an OBD connector.

Optionally, a SV comprises the entire payload of the OBD message.

Optionally, the PID of an SV comprises the MID of the OBD message that comprises the identified segment; an offset from the beginning of the OBD message in which the identified segment locates; and a number of bits of that segment.

Optionally, the required fleet-management parameters comprises information on the odometer value of the vehicle.

Optionally, the required fleet-management parameters and/or vehicular parameters may for example include but are not limited to road speed, odometer reading, level of fuel in the fuel tank of the vehicle.

Optionally, the act of obtaining a plurality of the transferred OBD messages may further comprise adding a timestamp to each obtained OBD message and/or vehicle bus data structure.

Optionally, the action of obtaining a plurality of the transferred OBD messages may further comprise organizing the obtained messages based on the time of obtaining the message.

Optionally, the action of analyzing the changes in time of each of the SVs may further comprise determining whether the time behavior of that SV represents at least one or more pattern selected from the group for example including but not limited to: a monotonically increasing in time pattern, a non-monotonic in time pattern, a sawtooth pattern in time, the like or any combination thereof.

Optionally, the act of defining the PID for the at least one identified required parameter may further comprises checking the correlation between the time behavior of an SV of the at least one identified required parameter with the time behavior of an SV of another identified required parameter.

Optionally the at least one identified required parameter may represent the odometer and the other identified required parameter may represent the road speed.

Optionally, the act of defining the PID for the at least one identified required parameter may further comprise checking the correlation between the time behavior of an SV of the at least one identified required parameter with an event. Optionally, the at least one identified required parameter represents the volume of the fuel in the fuel tank and the event may be an indication of the vehicle being located in a fuel station premises.

An optional embodiment of the present invention provides a method for identifying vehicular parameters of a vehicle by sniffing for data communicated over a vehicle data bus characterized in that the vehicular parameters are identified without interrogating the vehicle's central processor, the method comprising: sniffing to the vehicle data bus and recording data communicated thereon; parse the recorded vehicle bus data to form a plurality of vehicular parameter candidates; perform a plurality of statistical measurements for each of the candidates to define the candidates' statistical behavior; filter the candidates with at least one data behavioral modeling filter, wherein the data behavioral model is modeled to reflect the statistical behavior of known vehicular parameters; to associate each candidates with a vehicular parameter; group and sort candidates according to behavioral model therein matching candidates into groups representative of vehicular parameters; remove any candidate that are not matched and/or grouped to a vehicular parameter representative group; perform a correlation analysis between candidates grouped into a single vehicular parameter representative group to determine a correlation coefficient; score and sort candidates according to correlation analysis; and select winning candidates according to the score wherein the winning candidate represents a vehicular parameter.

Optionally the correlation analysis score is a function of the correlation coefficient.

Optionally the winning candidate is selected based on a score wherein the threshold correlation coefficient having an absolute value of at least 0.75.

Optionally the method may further comprise determining the scale of the candidates based on available a-priori data of any vehicular parameter, for example including but not limited to initial odometer reading. Optionally the a-priori data may be utilized for calibration.

Optionally, the statistical measure may for example include but is not limited to at least one or more statistical measure selected from minimum, maximum, mean, median, average, standard deviation, variance, distribution analysis, Gaussian distribution, the like or any combination thereof.

Optionally, parsing the recorded vehicle bus data comprises applying a data structure Filters provided to extract available data structure details for example including but not limited to at least one or more selected from the group: MSB position, LSB position, reading frames, BigEndian, LittleEndian, MiddleEndian, data prefixes, bit length, number of bytes, encryption codes, data sequence order, or any combination thereof.

Optionally, the recorded vehicle bus data message may be provided in the form of a message having a message header and payload, and wherein the message header comprises unique identifier in the form of a message ID (MID).

Optionally the candidates' statistical analysis and measure is performed on the payload portion of a vehicle bus data message. Optionally the candidates may be associated with the unique identifier message ID of a vehicle bus data message. Optionally data parsing may be performed on the payload portion of the recorded vehicle bus data. Optionally the candidates are formed from the payload portion of the vehicle bus data.

Optionally the method may further comprise performing a cross correlation between at least two or more candidates from different vehicular parameter groups wherein the vehicular parameter are correlated and have a known correlation function, the method comprising: forming a cross correlation data set including at least two or more candidates; perform a cross-correlation analysis between at least two or more candidates; and determine a scaling factor for the at least two or more candidates based on the cross-correlation analysis.

Optionally the cross correlation may comprise obtaining a-priori data of any available vehicular parameter for example including but not limited to initial odometer reading.

Optionally the winning candidate may be utilized to determine the scale of a parameter by comparison to a-priori data.

Optionally the method may be performed without recording vehicle data bus data, and be performed substantially simultaneously as data communicated over the vehicle data is made available and/or sniffed. Optionally, the method is performed substantially without recording intermediate data.

Within the context of this application the terms sniffing and/or listening may be used interchangeably to refer to the process of obtaining and/or reading vehicular data from the vehicle's data bus without interrogating and/or requesting the data from the vehicle central processing unit, therein allowing the vehicles' processor to continue to function without interruption.

Within the context of this application the terms candidates, parameter candidates and/or suspect vectors may be used interchangeably.

Within the context of this application the term vehicular parameters may refer to any parameter that may be associated with the vehicle. Vehicular parameters may include any data and/or data format that is associated with a vehicle directly, indirectly, during operation, while not in operation, manufacturer data, manufacturing history, driver data, owner data, vehicle sensor data, fleet management parameters, vehicle parts, driver behavior, servicing data, faults, vehicle system data or the like or any combination thereof. For example, vehicular parameter may for example include but are not limited to components, fluids, users, drivers, identification data, VIN, odometer, speed, fuel level, fuel volume, temperature, engine hours, sensor data, user data, driver data, the like or any combination thereof.

Unless otherwise defined the various embodiment of the present invention may be provided to an end user in a plurality of formats, platforms, and may be outputted to at least one of a computer readable memory, a computer display device, a printout, a computer on a network or a user.

Unless otherwise defined, all technical and scientific terms used herein have the same meaning as commonly understood by one of ordinary skill in the art to which this invention belongs. The materials, methods, and examples provided herein are illustrative only and not intended to be limiting.

Implementation of the method and system of the present invention involves performing or completing certain selected tasks or steps manually, automatically, or a combination thereof. Moreover, according to actual instrumentation and equipment of preferred embodiments of the method and system of the present invention, several selected steps could be implemented by hardware or by software on any operating system of any firmware or a combination thereof. For example, as hardware, selected steps of the invention could be implemented as a chip or a circuit. As software, selected steps of the invention could be implemented as a plurality of software instructions being executed by a computer using any suitable operating system. In any case, selected steps of the method and system of the invention could be described as being performed by a data processor, such as a computing platform for executing a plurality of instructions.

Although the present invention is described with regard to a "computer" and/or processor and/or controller it should be noted that optionally any device featuring a data processor and/or the ability to execute one or more instructions may be described as a computer, including but not limited to a PC (personal computer), a server, a minicomputer, a cellular telephone, a smart phone, a PDA (personal data assistant), a pager. Any two or more of such devices in communication with each other, and/or any computer in communication with any other computer may optionally comprise a "computer network".

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

The present invention relates to a device, system and a processor mediated method for obtaining and monitoring vehicular parameters and in particular, to such a device, system and method in which vehicular parameters are sniffed and automatically ascertained from a vehicle controller data bus without interrogating the vehicle's processor.

Embodiments of the present invention provide a device, system and method for accessing and making vehicular data available to an external processor and/or vehicular data management system, directly from the vehicle's on board processor without interrogating the vehicle's processor, while the vehicle is fully operational and/or driven.

Most preferably embodiment of the present invention provide for sniffing vehicular data communicated over the vehicle data bus, processing the sniffed data to ascertain and/or discover the vehicular parameters disposed therein and to communicate the discovered parameters to a third party processing unit and/or vehicular data management system.

The principles and operation of the present invention may be better understood with reference to the drawings and the accompanying description.

The following figure reference labels are used throughout the description to refer to similarly functioning components are used throughout the specification hereinbelow.

Figure 1:
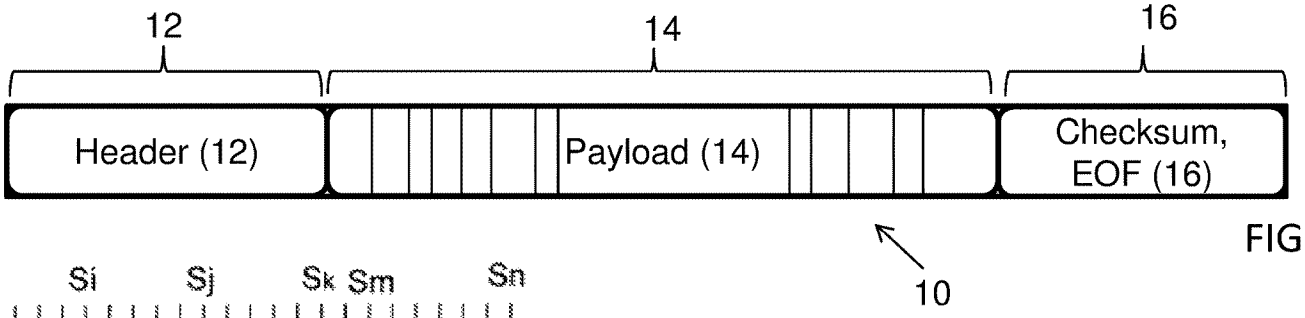
FIG. 1 is a schematic block diagram of the general data structure of a message containing vehicular parameters communicated by the vehicle's processor via the Vehicle Data Bus.

10 Message data structure;
12 Header;
14 Payload;
16 CheckSum, EOF
50 Vehicle;
52 Vehicle data bus;
54 vehicle on board central processor;
60 Vehicle data bus reader;
62 controller module;
64 memory module;
66 communication module;
70 modeling module;
72 Parameter Data modeling module;
74 Message Modeling Module;
76 Driver modeling module;
80 Third party data management system;

FIG. 1 shows an optional data structure made available by a vehicle's 50 on board central processing unit 54 via a vehicle data bus 52. Vehicle data bus 52 communicates vehicular parameters and data generated by the vehicle's central processor 54 in a data structure generally taking the form of messages 10 schematically depicted in FIG. 1. Message 10 comprises a message header 12, vehicular data payload 14 and end of file indicator 16.

Message header 12 includes a Message ID ('MID') utilized to identify data structure 10. Optionally header 12 may further comprise an indication of the size of the byte length of payload 14.

The vehicular data payload 14 comprises at least one vehicular data parameter and may comprise a plurality of vehicular data and parameters. However, payload 14 generally cannot be interpreted without interrogating and requesting the data from a vehicle's central processor 54.

The parameter location, reading frame, data size within payload 14, the number of bytes allocated to a parameter are not known or easily ascertained.

Message 10 and in particular payload 14 are not defined by a global standardization legislation that spans all vehicles manufactures. Although standardized vehicular protocols such as ISO-15031; Controller Area Network (CAN); OBD II; J1939 truck standard; ISO 9041 (K-line), and the like vehicular communication protocol do exist, however they generally govern protocols for servicing a vehicle that require interrogation of the vehicle's central processor 54. Furthermore, protocols utilized are not standardized across different manufacturer's or vehicle models.

Embodiment of the present invention provide a processor implemented method for ascertaining vehicular parameters from data structures and/or messages 10 communicated over the vehicle data bus 52 and in particular a method for ascertaining the vehicular data and/or parameters within payload 14, without interrogating the vehicle processor 54.

An optional embodiment of the present invention provides for ascertaining the vehicular parameters by processing the data obtained within a message 10 and in particular payload 14 by parsing the payload into a plurality of optional parameter candidates and/or suspect vectors and thereafter evaluating the plurality of candidates to identify those candidates that are representative of vehicular parameter.

Optionally the evaluation process may for example include but is not limited to at least one, or more and/or a combination of evaluation method selected from: applying filters, applying data masks, applying data behavioral models, parameter correlation analysis, scoring, thresholding, temporal analysis, applying transformation, applying hard rules, applying soft rules, comparison, the like or any combination thereof.

Figure 2A:
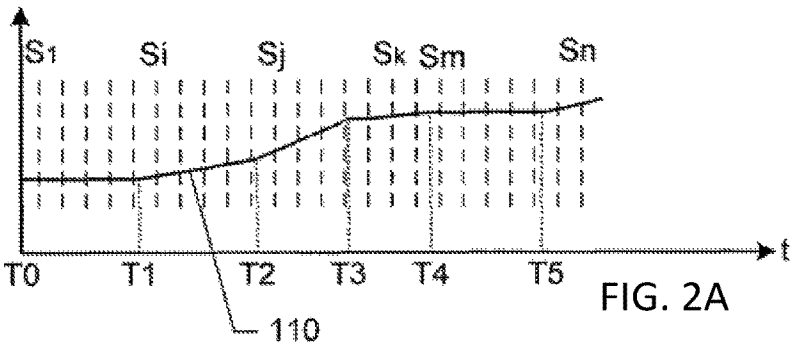
FIG. 2A-C are schematic illustration of the temporal behavior of optional vehicular parameters communicated over the vehicle data bus.
Figure 2B:
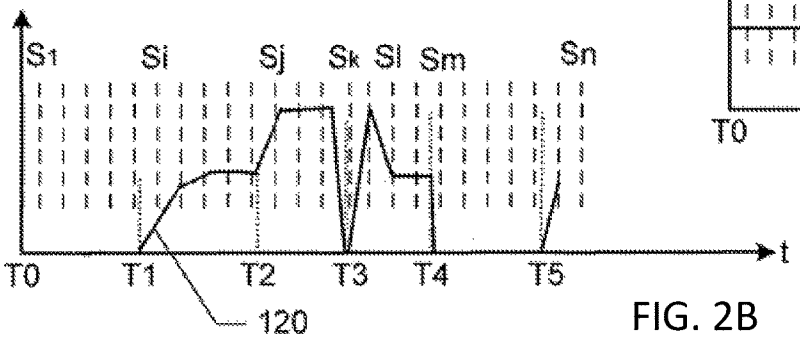
Figure 2C:
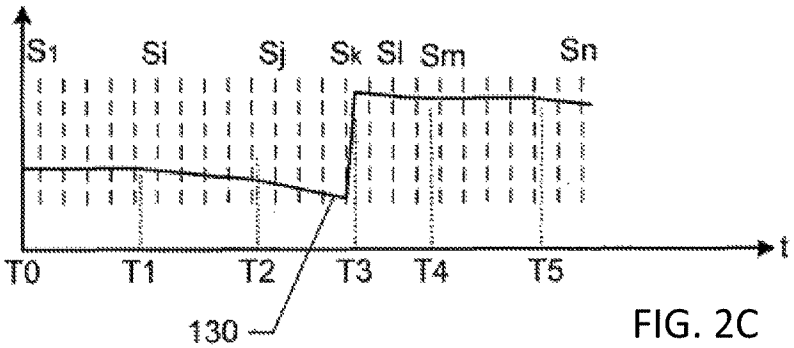

FIG. 2A-C are schematic illustrations of the temporal behavior of optional vehicular parameters. Optional embodiments of the present invention provide for modeling the behavior of vehicular parameters such as those depicted in FIG. 2A-C to facilitate the evaluation of candidates and/or suspect vectors.

Optionally the behavior of vehicular parameters may be used to abstract candidate evaluation tools for example including but not limited to rules, hard rules, soft rules, data behavioral models, data masks, correlation analysis, the like or any combination thereof.

FIG. 2A illustrates the temporal behavior 110 of the vehicle odometer. Pattern 110 may therefore be utilized to abstract evaluation tools that facilitate the identification of a payload 14 comprising vehicular data resembling the odometer reading.

Pattern 110 does not decrease in time and therefore may be utilized to abstract a hard rule relating to odometer candidates and/or suspect vectors. Similarly, other identifying features associated with the, vehicular parameter for example odometer, may be more specific to specific vehicles for example according to manufacture, make, year and/or model. Accordingly, such specific identifying features associated with vehicular parameters may be utilized by embodiment of the present invention to evaluate candidates and/or suspect vectors.

FIG. 2B shows the temporal behavior and/or pattern 120 that is associated with the vehicular parameter specifically, road speed. Pattern 120 may therefore be utilized to abstract evaluation tools utilized to evaluate message 10 and in particular payload 14 to ascertain candidates relating to road speed.

Road speed pattern 120 has non-monotonic shape where the changes in time are unexpected. Optionally patterns 120 may be utilized to abstract evaluation tools associated with thresholds and/or minimum and maximum values associated with a vehicular parameter.

Figure 2D:
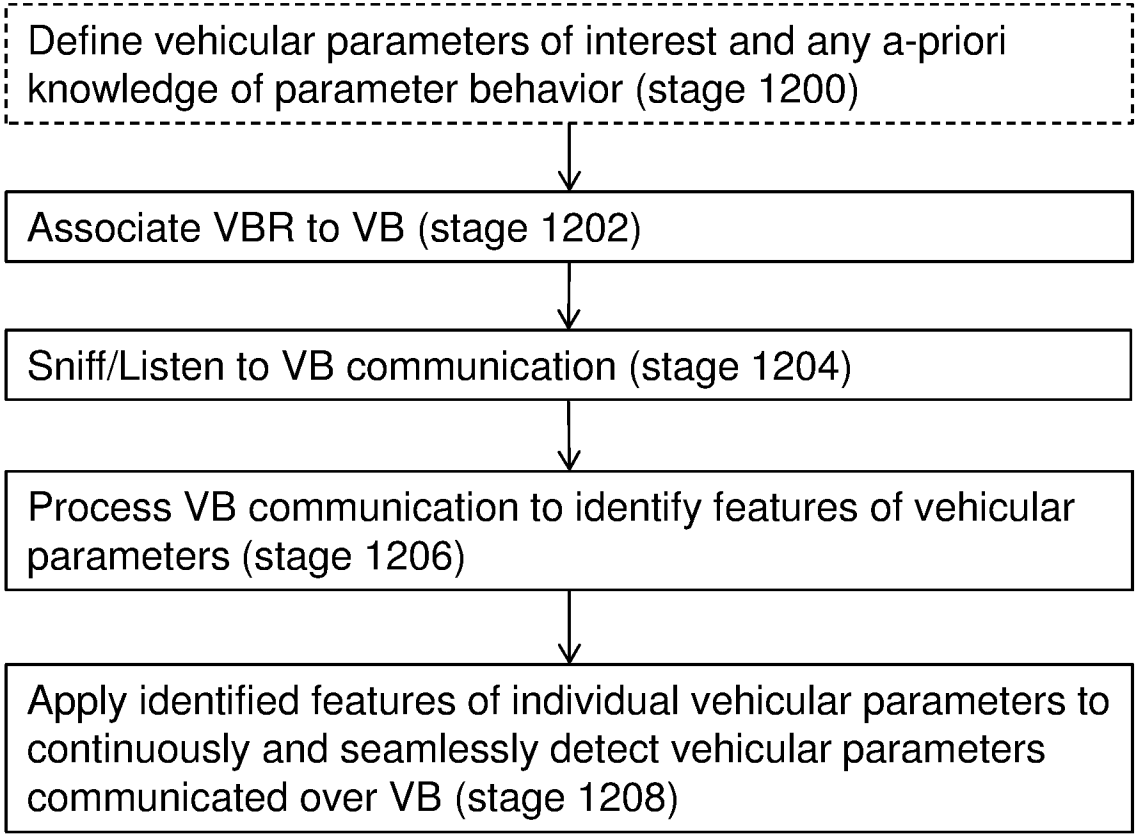
FIG. 2D is a flowchart illustrating a method according to an optional embodiment of the present invention.

FIG. 2C shows the temporal behavior and/or pattern 130 that is associated with the vehicular parameter specifically the amount of fuel in the fuel tank. Pattern 130 may be utilized to abstract optional evaluation tool based on the parameter behavior, for example including but not limited to setting limits, cross-correlation, FIG. 2D shows a flowchart depicting the processor and/or computer mediated method according to an optional embodiment of the present invention for ascertaining vehicular parameters by way of sniffing and/or listening to a vehicle controller data bus without interrogating the vehicle's processor, that is implemented by an optional vehicle data bus reading device 60 (VBR) of the present invention.

Most preferably the method initiates in an optional stage 1200 wherein vehicular parameters of interest are identified to VBR 60. Optionally a user and/or a fleet management system may define the vehicular parameter of interest to VBR 60. Optionally and preferably VBR 60 is provided with any a-priori data relating to the vehicular parameters of interest. For example a-priori data relating to the vehicular parameter may be defining identifying features of the parameter for example their temporal behavior over time, for example as depicted in FIG. 2A-C, expected values, performance limits (maximum speed), thresholds (maximum acceleration), or the like.

Next in stage 1202, the vehicle data bus reader 60 (VBR) according to optional embodiment of the present invention is associated with the vehicle data bus 52 (VB) so as to allow it to sniff and/or listen to communication transmitted on the data bus 52. Optionally the association may be wired, wireless or by way of induction.

Next in stage 1204 VBR 60 is activated and rendered and allowed to listen to and/or sniff and record data communicated over vehicle data bus 52, most preferably without interrogating and/or interrupting the vehicle processor 54. Optionally any a-priori data are implemented for calibration purposes.

Next in stage 1206, the recorded data from vehicle bus 52 is processed to define identifying features of the vehicular parameters of interest so as to allow for future seamless identification of the vehicular parameters. Optionally stage 1206 may be referred to as a learning phase where data from vehicle bus 52 is processed and learnt to understand how to seamlessly read vehicle data bus 52 without interrogating and/or interrupting vehicle processor 54. Optionally and preferably stage 1206 is a continuous phase that may be implemented in a number of optional methods by way of applying statistical analysis, sampling windows, filtering techniques, data masks, cross correlation, self-correlation and the like signal processing techniques to define the unique and identifying features, as will be defined in greater detail regarding optional embodiments of the present invention as described in FIGS. 5-10.

Next in stage 1208, once the identifying features for each vehicular parameter is defined in stage 1206, VBR 60 continuously and seamlessly monitors data communicated over vehicle bus 52 to identify and/or extract the vehicular parameters most preferably without interrogating the vehicle processor 54. Optionally and preferably vehicular parameters identified in stage 1208 may be communicated to a third party data management system 80, for example fleet management system.

Figure 3A:
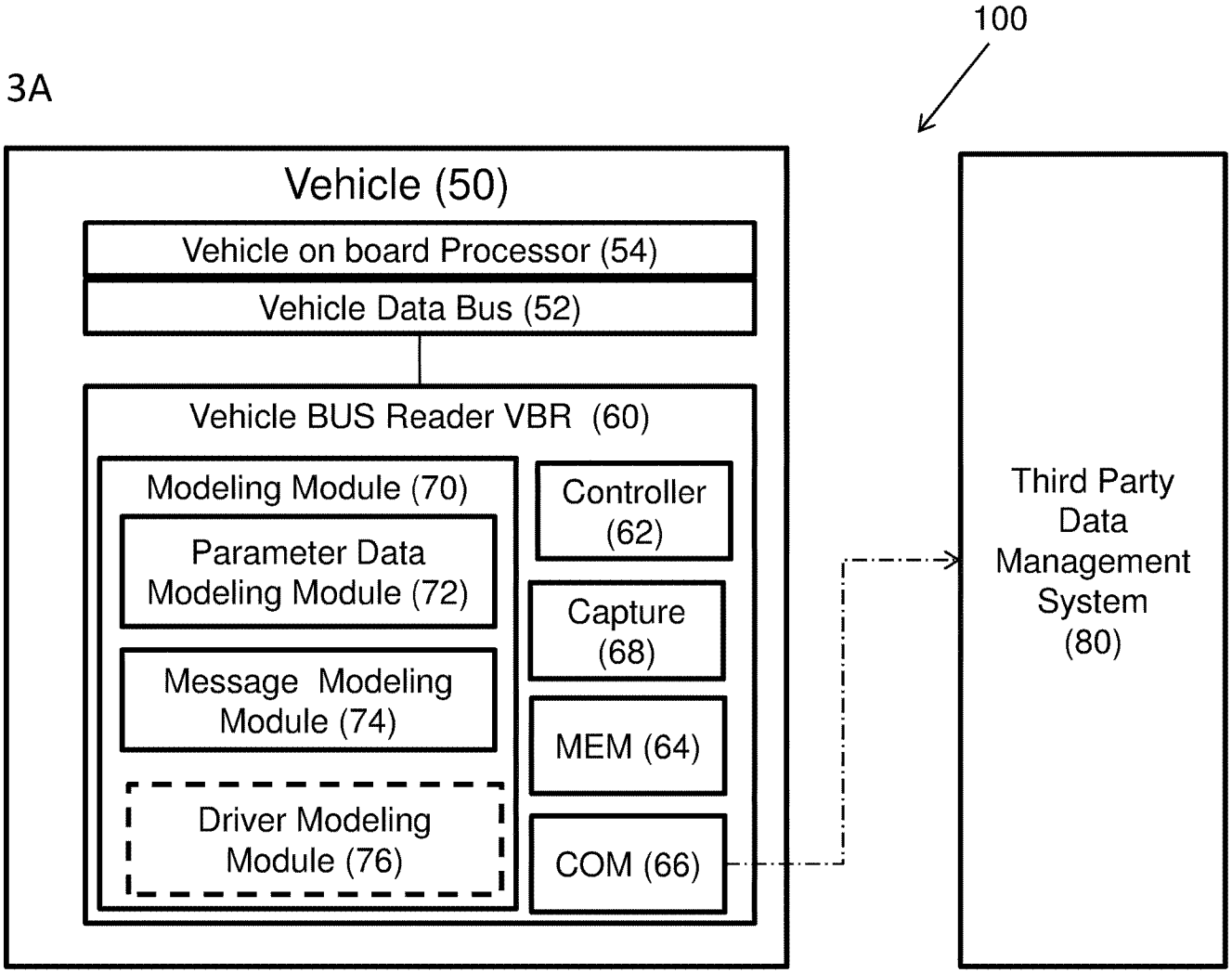
FIG. 3A is a schematic block diagram of a device and system for retrieving vehicular parameters from the vehicle data bus, according to an optional embodiment of the present invention.

FIG. 3A is a schematic block diagram of system 100 for ascertaining vehicular parameters from the vehicle data bus 52 without interrogating vehicle processing unit 54 by using an optional vehicle bus reader 60 according to optional embodiment of the present invention. Optionally and preferably system 100 provides for communication of vehicular data from vehicle bus reader 60 and a third party data management system 80.

Third party data management system 80 may be realized as a computer and/or server capable of communicating with bus reader 60, processing and storing data obtained from reader 60. Optionally communication between reader 60 and data management system 80 may be direct and/or indirect, for example via a data relay station.

Optionally data management systems 80 may be realized in optional propriety form and/or as part of a vehicle data managements system for example including but not limited to a fleet management system, vehicle insurance provider, legislation and/or government body, OEM parts manufactures, or the like.

Optionally the data management system 80 may be provided in optional forms for example including but not limited to a server, computer, mobile communication device, mobile computer, mobile processing device, a network, data processing center, fleet management system, vehicle manufacturer system, legislation and government systems, vehicle tracking systems, insurance provider systems, security systems, policing systems, parts manufacturer system, OEM parts manufacturer, the like or any combination thereof.

Most preferably vehicle bus reader 60 provides for implementing optional processor mediated methods for ascertaining vehicular parameters communicated over the vehicle data bus 52 without interrogating vehicle processing unit 54, as will be described in greater detail in FIG. 5-10.

An optional embodiment of the present invention provides a device provided in the form of a vehicle data bus reader 60 that is rendered operational within a vehicle 50. Most preferably data bus reader 60 provides for ascertaining a plurality of vehicular parameters associated with vehicle 50.

Optionally and preferably bus reader 60 may be rendered operational in two optional forms for example including learning phase and implementation phase. Optionally and preferably the learning phase provided by optional processor mediated methods according to the present invention allow bus reader 60 to learn and customize itself with respect to the vehicle 50 with which it is associated with over data bus 52. Most preferably the learning phase is provided to teach reader 60 how to read data transmitted and/or communicated over data bus 52 without interrogating and/or interfacing directly with the vehicle processor 54. Optionally the learning phase may comprise device calibration where known vehicular data for example initial odometer readings are utilized to calibrate reader 60. Optionally calibration stage may utilize any a-priori data relating to any vehicular parameter and/or operation. Optionally during calibration reader 60 may utilized at least one or more or a plurality of a-priori vehicular parameters.

Optionally and preferably once the learning phase is completed reader 60 enters implementation phase where reader 60 continuously ascertains vehicular parameters and data from vehicle data bus 52 in a timely manner.

Optionally the learning phase is ongoing and continuous process that is provided toward any new and/or unknown data structure and/or message 10 communicated and/or transmitted over vehicle bus 52.

Vehicular data and parameters are communicated to the vehicle's on board processor 54 from a plurality of sensors and/or actuators dispersed about vehicle 50 during its manufacture. Processor 54 utilizes the parameters and communicates the vehicular parameters over a vehicle data bus 52, optionally and preferably in a data structure taking the form of a message 10 as depicted in FIG. 1.

Reader 60 may be associated and/or functionally coupled with vehicle data bus 52 in optional forms for example including but not limited to wired, hard-wire, via a dedicated connector, wirelessly, by induction, via a data port, the like or any combination thereof.

Reader 60 preferably comprises a processor module 62, memory module 64, communication module 66, data capture module 68 and a modeling module 70.

Processor module 62 preferably provides for controlling the overall functions of reader 60 about its optional modules 64, 66, 68, and 70. Optionally processor module 62 may be realized in the form of a microprocessor and/or the like controller. Most preferably processor module 62 provides for controlling and/or carrying out the processor mediated method according to the present invention.

Memory module 64 preferably provides a data storage (read/write) for reader 60. Optionally module 64 may be realized in any form as is known in the art for example including but not limited to flash memory, volatile memory, non-volatile, the like or any combination thereof.

Communication module 66 may be realized as a receiver transceiver that provides for wired and/or wireless communication for reader 60. Most preferably communication module 66 provides for external communication with optional third party systems 80. Optionally communication module 66 may provide for communication with vehicle data bus 52. Optionally communication through communication module 66 may be encrypted. Optionally the encryption may be based on encryption algorithm as is known in the art for example including but not limited to MD5, or the like.

Optionally module 66 may further provide for communicating directly with processor 54.

Data capture module 68 preferably provides for obtaining and/or recording data communicated on vehicle data bus 52. Optionally and preferably capture module 68 provides for sniffing data communicated about vehicle data bus 52 in a seamless manner without interrogating processor 54.

Optionally capture module 68 may be realized in the form of a sampling module provided for sampling data communicated on vehicle bus 52.

Data modeling module 70 most preferably provides for modeling and evaluating data originating from data structure 10 and/or a vehicular parameters candidates that are sniffed from vehicle bus 52 for example by way of utilizing capture module 68. Optionally modeling module 70 provides for facilitating the evaluation and processing of parameter candidates and/or suspect vectors according to optional tools for example including but not limited to applying at least one or more filter, threshold, rules, hard rules, soft rules, data masks. data behavioral models, parameter correlation analysis, temporal analysis, transformations, self-correlation, cross-correlation, statistical analysis, the like or any combination thereof.

Optionally module 70 may comprise modules facilitating data modeling and processing for example including but not limited a parametric data modeling module 72, Message and/or data structure modeling module 74, the like or any combination thereof.

Optionally module 70 may further comprise modeling modules relating to the operation of a vehicle beyond the vehicular parameter generated by the vehicle operation. For example module 70 may further comprise a driver modeling module 76 and/or a driver behavior module that optionally provide a higher order parametric analysis based on vehicular parameters, that may for example be utilized as a signature for individual drivers and/or generalized for driver behavior.

Optionally data contained within and/or utilized to form the various models utilized with module 70, may be abstracted intrinsically by reader 60 and/or optionally may be obtained in combination with external data for example from a third party data source 80. For example, an optional third party data management system 80, for example fleet management system, may provide the data utilized for building the optional modeling modules comprising module 70.

The VBR 60 may optionally be powered get electrical power from the vehicle electrical system. Optionally in some embodiments of VBR 60 may comprise chargeable energy storage, such as a large capacitor. Other embodiments may use a rechargeable battery. The energy storage may be used to keep the VBR 60 active during the periods that the vehicle is switched off. Some example embodiments of VBR 60 that has energy storage device may further have a clock (date and hours, minutes, or the like). The clock may be adjusted during the installation of the VBR 60.

Optionally VBR 60 may operate in two modes of operation, a learning period and an ongoing mode. The learning period may be executed after the installation of the VBR 60 or each time the vehicle-onboard processor is loaded with a new software version. That may influence the data structure and/or message 10 communicated over the vehicle bus 52.

Optionally during the learning period the VBR may operate to identify the data structure and/or message 10 utilized by vehicle 50 over data bus 52. Preferably the learning period is provided to facilitate quicker and/or streamlined identification of vehicular parameters by VBR 60 from data communicated over data bus 52.

Optionally during the learning phase VBR 60 may be limited to learning a subset of vehicular parameters including at least one or more vehicular data for example including but not limited to odometer readings, speed, fuel volume, the like or any combination thereof.

Optionally during the ongoing mode, VBR 60 may be configured to monitor and/or collect data that is related to a certain subset of parameters. Optionally the subset of vehicular parameters during the monitoring phase may be depicted by a user and/or a third party data management system 80, for example a fleet management system.

Optionally after communicating the vehicular data stored in VBR 60 to a third party data management system 80, VBR 60 may release some and/or all of the data stored in memory module 64. Optionally VBR 60 may optionally keep a baseline of a subset of vehicular data that may be utilized to facilitate future reading of vehicular data, for example including but not limited to the last odometer reading, the previous fuel tank volume, last refueling occurrence, the like or any combination thereof.

Optionally, in some embodiments of VBR 60 may be configured to ascertain vehicular events that do not originate from the vehicle bus 52 and/or processor 54. For example, VBR 60 may be configured to identify the end of a re-fueling event by cross referencing at least two events. For example, vehicle ignition and initiation coupled with the receipt of a welcome beacon from fuel-station premises the forms part a fleet management system, as will be described in below, may indicate the end of a re-fueling process. Optionally if end of refueling event is identified VBR 60, may initiate communication for example with communication module 66 with a an optional third party system 80, for example a refueling station form a part of fleet management system, to obtain the fuel volume dispensed in the re-fueling process and/or the like detail relating to the fuel purchasing transaction.

Figure 3B:
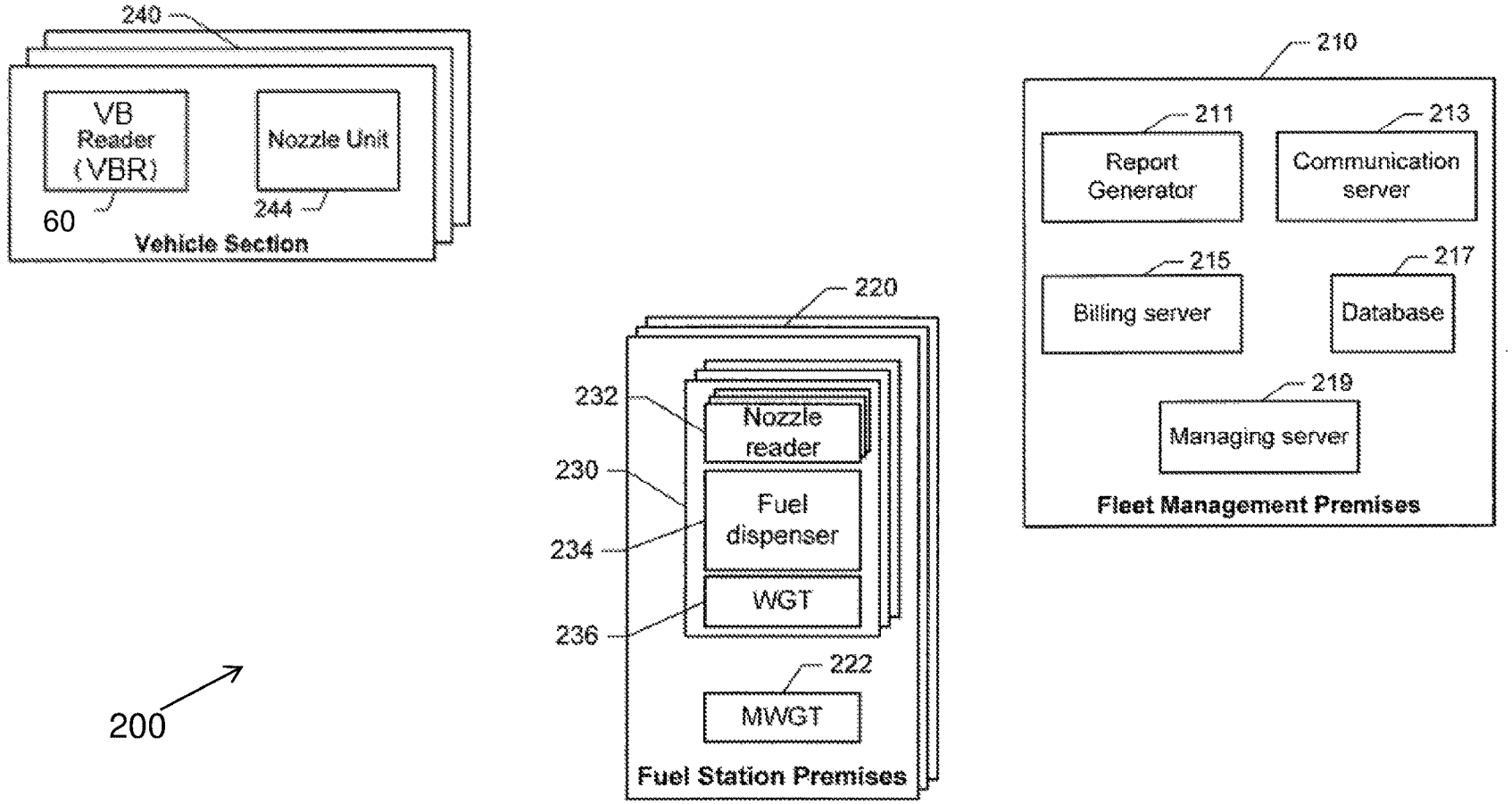
FIG. 3B is a schematic block diagram of an optional device according to the present invention for the retrieval of vehicular parameters from the vehicle data bus within a fleet management system environment.

FIG. 3B is a schematic block diagram of an optional system 100 comprising a vehicle bus reader (VBR) 60 in use with a third party data management system 80 shown in the form of a fleet management system 200 according to an optional embodiment of the present invention. FIG. 3B shows the implementation of reader 60 utilized within a non-limiting functional framework in the form of a fleet management system environment 200 comprising a fleet management premises 210, a fuel station premises and a plurality of vehicles 240.

As is known in the art, fleet management premises 210, may comprise at least one or more of a report generator server 211, a communication server 213, a billing server 215, a database 217 and a managing server 219, which are in communication with one another. Fleet management premises 210 provides for managing a fleet of vehicles 240 by storing and processing various forms of vehicular data. Fleet management environment 210 may be utilized to generate reports relating to any portion and/or member forming a part of the fleet for example including but not limited to its vehicles, operators, repair personnel, drivers, servicing personnel, service stations, the like or any combination thereof.

As is known in the art, fuel station premise 220 may comprise a, master gateway 222 and a fuel dispenser portion 230. Master gateway 222 provides for facilitating communication with fleet management premises 210 Fuel dispensing portion 230 provides for facilitating communication between nozzle unit 244 of vehicle 240 and gateway 236 via fuel dispensing nozzle 234 and nozzle reader 232, for example utilizing RFID technology as is known and accepted in the art include RFID tags and RFID readers.

Preferably vehicles 240 forming the fleet managed with fleet management system 200 comprise a VBR 60. Preferably VBR 60 provides for attaining vehicular data and/or parameters available via vehicle bus 52 to communication the vehicular data to fleet management s premises 210. Optionally vehicular data may be communicated from VBR 60 to fleet management premises 210 via fuel station premises 220 acting as a data relay station between vehicle 240 and fleet management premise 210.

Optionally, vehicular data may be communicated from VBR 60 to fleet management premise 210 via fuel station premise 220 during refueling transaction for example in the following manner: i) vehicular data is attained, processed and stored by VBR 60 during the operation of vehicle 240 according to optional embodiment of the present invention; ii) VBR 60 that is functionally associated with a nozzle unit 244 makes the vehicular data available to nozzle unit 244 when vehicle 240 is in a fuel station premises 220 and associated with nozzle reader 232 disposed on a fuel dispenser 230; iii) vehicular data is transmitted from nozzle unit 244 to nozzle reader 232 and onto gateway 236; iv) gateway 236 in communication with master gateway 222 communicates the vehicular data to fleet management premises 210 for example via communication server 213 for further processing.

Optionally, vehicular data may be communicated from VBR 60 to fleet management premise 210 via fuel station premise 220 for example in the following manner: i) vehicular data is attained, processed and stored by VBR 60 during the operation of vehicle 240 according to optional embodiment of the present invention; ii) VBR 60 may communicate with at least on of gateway 236 and/or master gateway 222, for example via communication module 66, iii) gateway 236 and/or master gateway 222 may communicate vehicular data originating from VBR 60 to fleet management premises 210, for further processing.

Optionally vehicular data may be communicated and/or relayed to fleet management premises 210 while vehicle 240 is in refueling premises 220.

Optionally vehicular data originating in VBR 60 may be stored in fuel station premises 220 for example in master gateway 222 while vehicle 240 is in refueling premises 220 and communicated to fleet management premises 210 at any time irrespective of the location of vehicle 240.

Optionally VBR 60 may be utilized to communicate a plurality of vehicular data to fleet management premises 210 that may for example include but is not limited to at least one or more of the following management parameters: the vehicle ID, the time, the location of the fuel station, the last value of the odometer, the last value of the amount of fuel in the tank before entering to the fuel station, the average road speed, the maximum and minimum speed during the reporting period, the working mode of the VBR 60 (learning period or ongoing mode), working hours, irregular parameter readings, or the like. For example, irregular and/or unexpected vehicular parameter reading may for example represent fuel-sudden drop or the like phenomena.

In some example embodiments of fuel management system 200, the MWGT 222 may be configured to inform the VBR 60 that the fueling stage was terminated. The MWGT 222 may inform VBR 60 about the amount of fuel that was loaded in this visit. Optionally, during the learning period the fuel volume level may be used for calibration purposes for example to determining the ratio between the reading of a suspected vector and/or candidate that represent the fuel tank and the volume in litters. Optionally during the ongoing mode the amount of fuel may be used by the VBR 60 in order to determine fraud and/or fuel theft, for example.

Optional embodiments of system 200 may use a proprietary wireless protocol communication between a MWGT 222 and VBR 60. In other embodiments of system 200 the wireless communication may use a standard wireless-local-area network (WLAN) protocol such as but not limited to IEEE 802.11, IEEE 802.15.4, for example.

Figure 4:
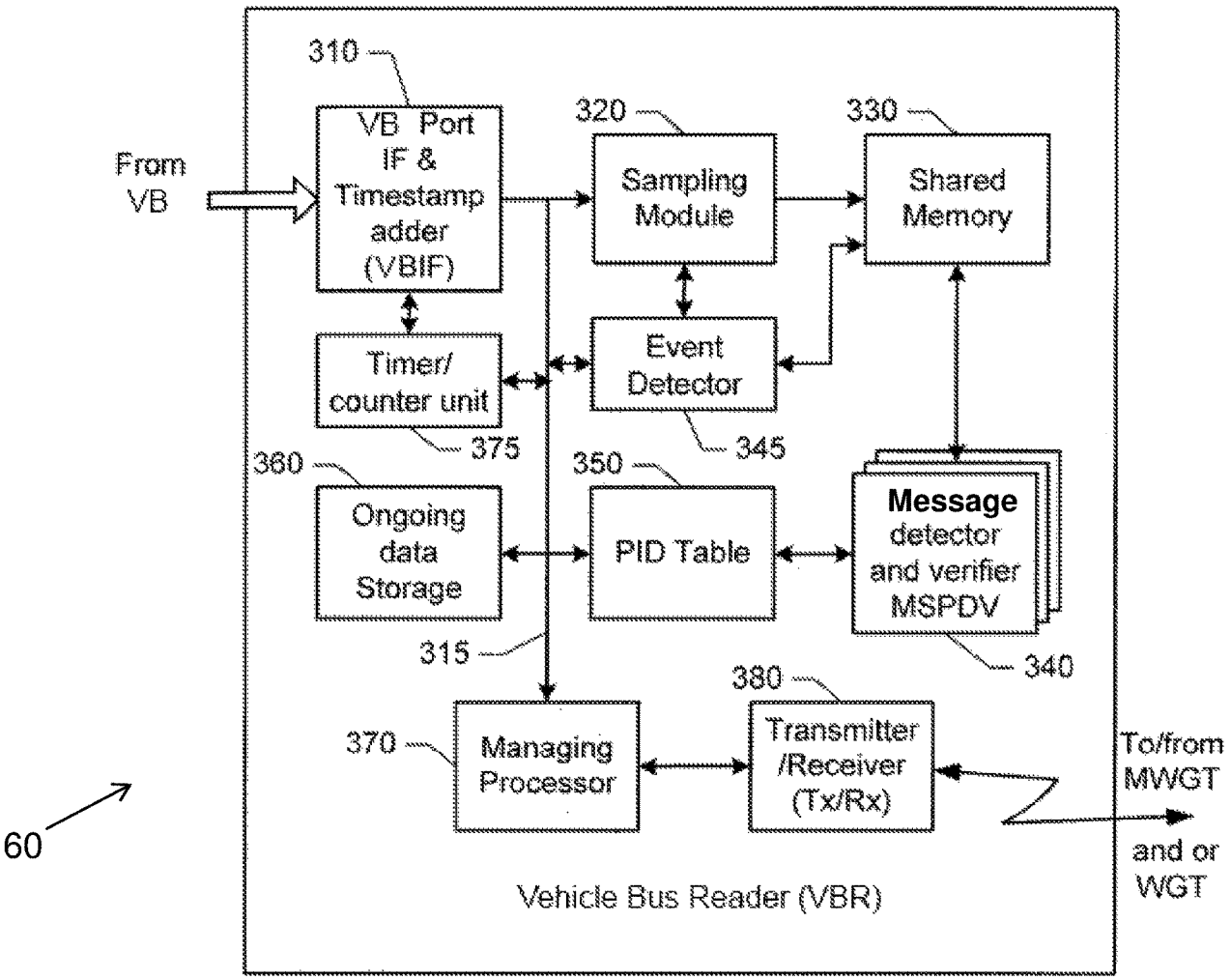
FIG. 4 is a schematic block diagram of an optional vehicle bus reader (VBR) device according to an optional embodiment of the present invention.

FIG. 4 is a schematic block diagram of an optional embodiment of vehicle bus reader (VBR) 60 similar to that depicted in FIG. 3A.

VBR 60 may comprise a vehicle data bus interface module (VBIF) 310, a sampling module 320, a shared memory 330, an event detector module 345, a timer and/or counter unit 375, at least one or more vehicle bus data structure and/or message detector-and-verifier modules (MSPDV) 340, PID table 350, Ongoing-data-storage device 360, a managing processor 370, a transceiver/receiver unit 380, and an internal common interface 315.

Optionally and preferably interface 315 provides to enables data transfer between at least two or more internal modules comprising the VBR 60.

Optionally and preferably shared memory 330 and ongoing data storage device 360 providing device memory are comparable to and/or parallel in function to memory module 64 depicted in FIG. 3A.

Optionally and preferably VBIF 310 and sampling module 320 provide for interfacing with vehicle data bus 52 and sampling message 10 attained therefrom, are comparable to and/or parallel in function to capture module 68, depicted in FIG. 3A.

Optionally and preferably PID table 350, message detector 340 and Event detector 345 provided for detecting messages and events within a message 10 are comparable to and/or parallel in function to modeling module 70, depicted in FIG. 3A.

Optionally and preferably Tx/Rx module 380 provided for communication transmission and receipt is comparable to and/or parallel in function to communication module 66, depicted in FIG. 3A.

Optionally and preferably managing processor 370, internal common interface 315 and timer and/or counter unit 375 provide for overall control and processing are comparable to and/or parallel in function to controller module 62, depicted in FIG. 3A.

Optionally of the common interface 315 may be provided in the form of an internal bus for example including but is not limited to a Time-Division Multiplexing (TDM) bus, or the like components that facilitates data and/or memory sharing between the components of VBR 60. Optionally common interface 315 may be provided in the form of a shared memory that allows for and acts as a common and/or shared resource that provides for memory reading and/or writing rights to at least two or more modules.

Optionally event detectors 345 may be provided in the form of at least one or more detectors and/or sensors and/or filters. Optionally individual detector may be configured to detect at least one and more preferably a plurality of events that may be used by one or more of the internal modules of VBR 60. For example, a detector 345 may be adapted to identify data relating to the vehicle operation that are not necessarily communicated over the vehicle data bus 52, for example such an event may for example include but is not limited to detecting when the engine is turned on, idle time, the like event or any combination thereof.

Optionally detector 345 may facilitate detection of events by performing an analysis and sensing fluctuations for example in vehicle voltage levels as the data is communicated to the Vehicle data bus 52.

Preferably when an event is triggered and/or detected and/or sensed by detector 345 it may produce a secondary triggered and/or event that is made available and/or communicated to the modules comprising VBR 60. Optionally secondary triggered events may for example include but is not limited to generating reports, recording specific data, recording and/or registering the occurrence of a time based event, undertaking analysis or the like or any combination thereof.

For example, events detector 345 detects a voltage differential step, (sudden drop and/or increase) of about 2 volts in the vehicle voltage. Such an event may cause event detector 345 to send an ignition indication to sampling module 320 and to the timer/counter unit 375 to initiate recording and sampling due to vehicle ignition, Optionally event detector 345 may comprise and/or associated with sensors for example including but not limited an accelerometer chip. Optionally accelerometer chip may optionally and preferably be provided to sense the acceleration status of the vehicle. Optionally such an accelerometer chip may determine acceleration and/or deceleration rate of a vehicle, for example relative to a threshold and/or limit. Optionally, such an accelerometer may be a micro-electro-mechanical system (MEMS) device, as is known in the art.

Optionally the MEMS accelerator may deliver accelerating and/or decelerating indication to sampling module 320, for example, that in turn may be used by one or more MSPDV 340 to verify vehicular data for example including but not limited to road speed, fuel reading, the like or any combination thereof.

Optionally the timer/counter module 375 may deliver a timestamp to be used by the VBIF 310 and by the event detector 345. An example of timer/counter module 375, that may be included in a VBR 60 is a clock that may deliver the date and the time in the accuracy of milliseconds and having an internal battery.

Optionally module 375 may be provided in the form of a real time clock. The clock may be adjusted during installation and/or calibration. Optionally the clock may be readjusted by the MWGT 222 each time the vehicle visits a fuel station premises 220.

Optionally a VBR 60 that does not comprise a battery; may utilize a timer/counter module 375 that may have at least two counters, that function based on the identification of an most significant byte ('MSB') and least significant byte ('LSB') portion of a message 10. Optionally and preferably a first counter may be sensitive to the MSB and a second counter sensitive to LSB. A first counter, provided in the form of an MSB counter, may have two bytes, for example. The value of this counter may be used as the MSBs of the timestamp. The counter may be initiated during installation and/or calibration and may be incremented each time an ignition indication is received from the event detector 345. Preferably this form of a counter may be stored in a permanent memory device such as flash memory for example. Such a memory may be part of the ongoing data storage device 360. A second counter, the LSB counter, may be reset per each received ignition indication. The LSBs counter may be incremented each millisecond by a pulse generator that is associated with the timer/counter module 375. Optionally and preferably the values of the MSB counter and the LSB counter may be used as a timestamp.

Most preferably VBIF 310 functions to sense, sniff, read, and/or obtain data structures and/or messages that are transferred over the Vehicle data bus 52 without interrogating the vehicle controller and/or computer.

Sampling module 320 preferably operates during a learning phase. Preferably sampling module 320 is capable of collecting processed messages from the internal bus 315, more preferably in the form of messages 10 that were previously processed by the VBIF 310. Each processed message optionally and preferably comprises a header with relevant fields such as timestamp field, MID field, the length of the payload, or the like, as provided by VBIF 310.

Optionally sampling module 320 may utilize a sampling windows of varying length. Optionally and preferably the sampling window length may be determined based on message data optionally and preferably included in the header portion 12 for example including but not limited to a PID, MID, the like or any data identified with respect to the message.

Optionally each sampling window may have a variable and controllable duration that is in the order of seconds to minutes. Optionally sampling window duration may be about an hour. For example, a sampling window may have a length of about 20 seconds and up to about 40 minutes.

Optionally the lag between sampling windows may be determined based on data and/or data portion within message 10 for example including but not limited to a PID, MID, MSB, LSB or any data identified with respect to the message.

Optionally the lag time between sampling windows may be on the order of seconds, of minutes, and/or tens of minutes and up to a few hours. For example the time lag between sampling windows may be 20 seconds to 80 minutes for example.

Optionally the sampling windows length and/or lag may be forced for and determined by event detector 345. Optionally, a sampling window may be initiated and/or forced when the event detector 345 receives an indication from the Tx/Rx module 380 that the vehicle enters into a fuel station. Another example of a forced sampling window by module 320 may be due to receiving accelerating/decelerating indication from the event detector 345. Yet another example of an optional forced window may be due to receiving ignition-on indication from the event detector 345.

Optionally at the end of a sampling window, sampling module 320 may sort the stored messages into groups, for example according to the MID.

Optionally and preferably VBR 60 may comprise at least one and more preferably a plurality of message detectors 340, provided to identify a particular vehicular parameter and/or PID. Optionally detectors 340 provide for identifying characteristic cues relating to a particular parameter for example correlation with the temporal behavior of a particular parameter for example ad depicted in FIG. 2A-C. Optionally detectors 340 may be realized by implementation of rules such as hard rules and/or soft rules.

Figure 5:
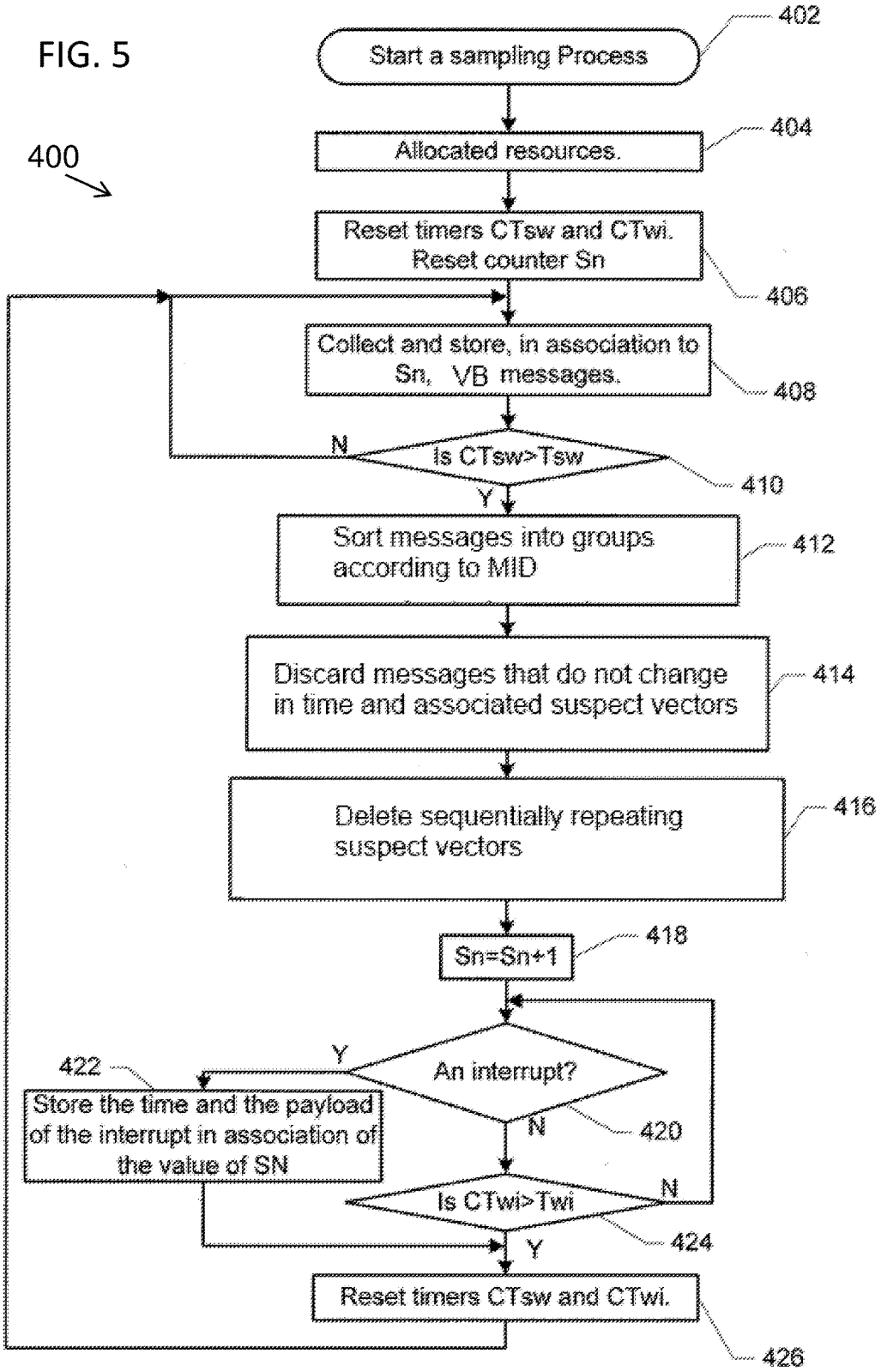
FIG. 5 is a flowchart illustrating a method according to an optional embodiment of the present invention for sampling messages transferred over a vehicle data bus.

FIG. 5 is a flowchart illustrating a method 400 according to an optional embodiment of the present invention for sampling messages transferred over a vehicle data bus 52.

Processor mediated method 400 shows the stages for obtaining and/or sampling data communicated and/or transmitted over vehicle data bus 52, for example in the form of messages 10, without interrogating the vehicle processor 54. Optionally and preferably method 400 represents an optional method that may be implemented during a learning phase of VBR 60 and/or at any time when communication over vehicle data bus is not identified by VBR 60.

Optionally and preferably embodiments of method 400 may be implemented by an sampling module 320 and/or capture module 68.

Processor mediated method 400 may be initiated in stage 402 by the managing processor 370, 62 after functionally associating and/or interfacing VBR 60 with vehicle data bus 52, in a vehicle 50. During the initiation, VBR 60 may be loaded with authentication information for example including but not limited to keys needed for encryption/decryption, specific vehicular identification details such as VIN, current odometer readings, ownership data, the like or any combination of vehicular identification features. Optionally, initial vehicular data entered in stage 402 may for example include but is not limited to, maximum road speed, absolute fuel tank volume, current fuel tank levels, maximum acceleration, current odometer readings, the like and any combination thereof.

Next in stage 404, VBR 60 resources that may be needed for the sampling process are allocated by processing module 370, 62. The resources may comprise storage resources from the shared memory 330 an/or memory module 64, wherein a shared-memory-management table ('SMMT') may be allocated. Optionally timers and counters used during the sampling process may be similarly allocated.

Next in stage 406, preferably the allocated resources are primed and/or reset. For example, Timers and counters such as CTsw provided for defining the duration of a sampling window, an optional CTwi provided to define the intervals between two consecutive sampling windows, may optionally be reset. Optionally a counter Sn may be reset. Counter Sn may be provided for counting and defining the serial number of each sampling window.

Most preferably following stage 406 the sampling process is ready to start to allow VBR to actively sniff and/or listen to the vehicle data bus 52. Optionally VBR 60 may alternatively initially record data communicated over data bus 52 and processes the stored data originating from data bus 52.

Next in stages 408 and 410 sampling is implemented with sampling module 320 and/or capture module 68 to collects messages from the data bus 315 and/or 52 and stores them in a section of the shared memory 330 and/or memory module 64 that is optionally and preferably associated with the current sampling window, window number Sn.

In stage 410 the sampling window is implemented and maintained according to defined sampling window length and timeframe. Preferably sampling continues for the duration of the sampling window. Optionally the length of the sampling window may be in the order of seconds, minutes, and/or hours. For example, a window length may be in the range of few minutes, for example from about 20 seconds to about 4 minutes and/or the like.

Next in stage 412, following the end of the sampling window, data sampled from data bus 52 and/or 315 are processed.

Next in stage 412 optionally the stored messages are sorted optionally in a number of stages and/or levels. Most preferably sorting is initiated allowing for sorting and/or grouping messages according to the MID, provided in the header 12 of message 10. Optionally, the sorted messages may be further sorted according to their timestamp. Optionally and preferably the sorted stored messages of each group may be store in the memory.

Next in stage 414 sampling module 320 may perform initial filtering by scanning each stored group of MID looking for groups of MIDS that do not change in time during that sampling window. An example of method 400 may assume that each of the required fleet management parameters changes during the period of the sampling window. Thus, groups of messages having the same MID and do not change in time may be ignored and/or deleted. Those groups may be deleted from further consideration.

Next in stage 416 each of the remaining groups that show changes in time may be further processed. Data is sorted in the time domain, according to their timestamp, to ensure that each message has a payload that differs from the payload of its previous stored message.

Next in stage 418 the Sn counter may be incremented 418 by one so as to update the window. Optionally the new value of Sn may be transferred also to the timer/counter unit 375.

Next a decision may be made 420 whether an interrupt was received. An interrupt may be received from the event detector module 345, for example. An example interrupt may represent: the ignition of the vehicle, entering into a fuel station premises 220 (FIG. 3B), acceleration/deceleration, or the like. If yes, in stage 422 the interrupt may optionally be stored in the shared memory in association with Sn, for ease of identification. The header of the interrupt may include the timestamp, an identification of the type of the interrupt, the length of the payload and the payload itself. The payload may define one or more values that are related to that interrupt. Then at block 426 the timers CTsw and CTwi may be reset and method 400 may return to block 408 starting a new sampling window.

If in stage 420 there is no interrupt, the method continues sampling as depicted in stage 424 to determine whether the value of CTwi is greater than a value of Twi in minutes, for example to determine if the sampling window time has expired for example. If not, process 400 returns to block 420. If 424 the value of CTwi is bigger than Twi in minutes, then a next sampling window may be started and method 400 proceed to stage 426.

Next in stage 426 counter and timers are rest and the next sampling window is allowed to initiate.

Figure 6:
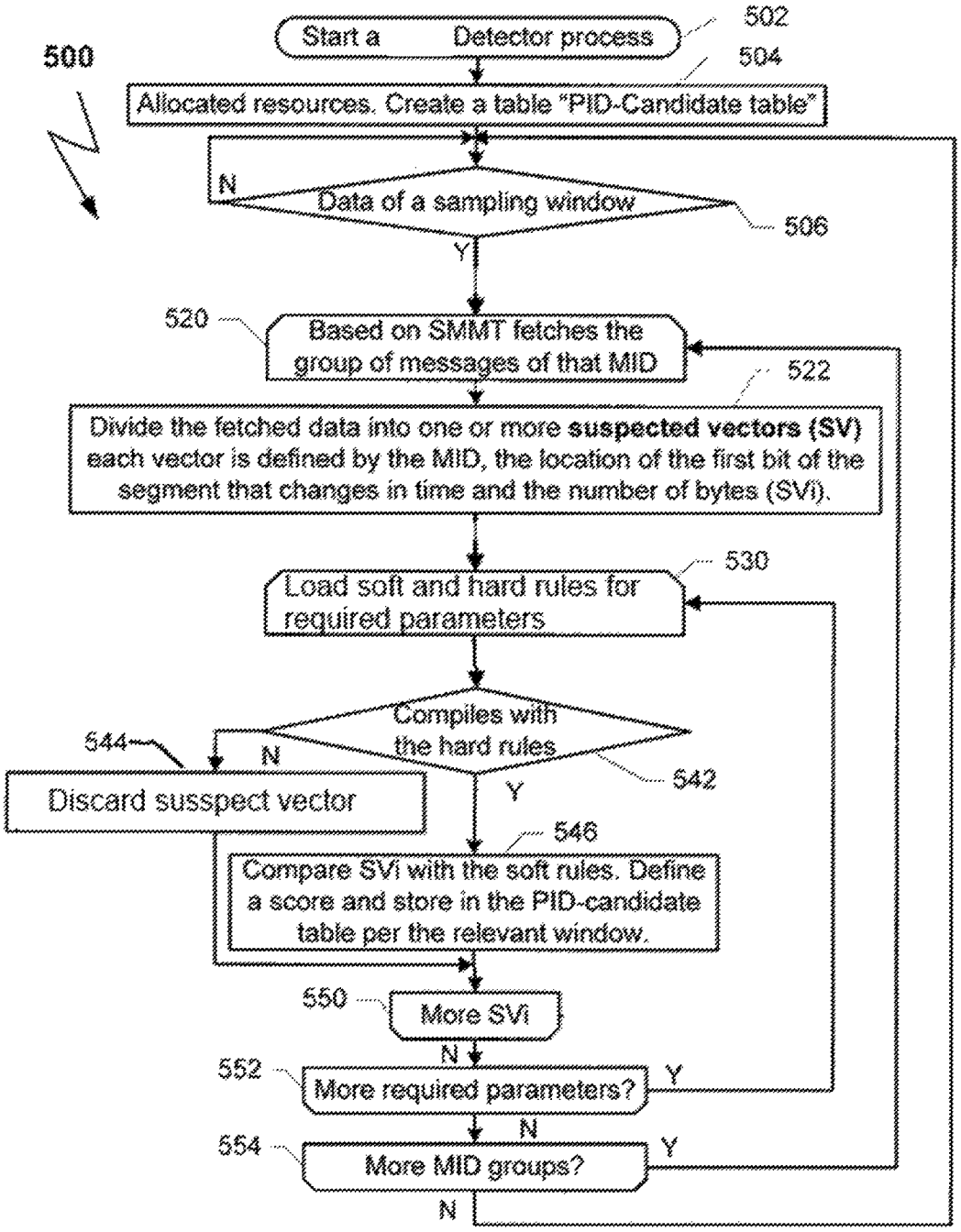
FIG. 6 is a flowchart illustrating a method according an optional embodiment of the present invention for detecting parameter candidates from vehicle data bus messages.

FIG. 6 shows a flowchart of a processor mediated method 500 for ascertaining vehicular parameter candidates from communication transmitted over data bus line 52 that is optionally and preferably recorded and/or sampled as previously described.

Optionally and preferably method 500 may be implemented by an embodiment of VBR 60, during a learning phase as previously described. Optionally and preferably method 500 may for example be implemented with MSPDV 340 and/or modeling module 70.

First in stage 502 the method is initiated and governed with by processor 370, 62. Next in stage 504 computing resources as well as storage resources, for example in memory 330, 64 may be allocated, by the managing processor 370,62, most preferably for supporting the implementation of method 500. Optionally a Parameter ID table may be allocated with an optional memory store 64, 330. The PID table provided for storing vehicular parameter candidates that are extracted from the data structure and/or message 10 communicated over data bus lines 52. Optionally, a PID-candidate table may be allocated per each sampling window and each required parameter.

Optionally, soft rules and hard rules relating the vehicular parameters may be made available, for example by loading to the shared memory 330, 64.

Next in stage 506 sampling window data, Sn, is provided from sampling module 320 and prepared for further processing to identify the parameter data available in the data structure 10.

Next in stage 520 data from sampling processing module 320 that is preferably sorted for example by MID is loaded from memory 330.

Next in stage 522 the sampling data is parsed and/or segmented defining a plurality of suspect vectors (SV) and/or parameter candidate. Most preferably each SV may be identified by at least one or more of the MID, the location of the segment within the message 10, and the number of bits/bytes of that segment. Optionally, a suspect vector may be located and/or identified by at least one or more selected from: number of bits, the relative MSB position, relative LSB position, and/or scale factor.

Next in stage 530 rules are uploaded for example including but not limited to Hard and soft rules, obtained from at least one of module 340, 345, 70. Optionally rules that are uploaded and may be limited to and/or specific to the set of suspect vectors being observed.

Next in stage 542 a suspect vector and its temporal behavior is evaluated relative to the hard rules to determine if the suspect vector complies and/or adheres to the hard rules specific to a parameter.

If the suspect vector's temporal behavior matches that of the hard rules associated with a specific vehicular data then move to stage 546. If the suspect vector temporal behavior does not match the temporal behavior of the hard rules, for example FIG. 2A-C, move to stage 544. For example if the temporal behavior of the suspect vector resembled the temporal behavior of fuel tank level, FIG. 2C, then it would be rejected for hard rules relating to odometer, for example but reconsidered for a different set of hard rules.

Next in stage 544 the suspect vector is removed from consideration for the parameter associated with the hard rule. Optionally and preferably the failure is recorded within the PID table.

Next is stage 546 the temporal behavior of the values of the segment of that SV is further tested relative to at least one or more soft rules. Optionally soft rules may be made available by modeling module 70, 340, 345 and/or memory 64 and/or third party data management system 80.

An example of soft rule may for example include but is not limited to the rate of changes of a certain parameter, the maximum values of certain parameters, minimum value, any combination thereof or the like. For example, the speed of a family car may not be above 220 km/h, the speed of a heavy truck may not be above 150 km/h, or the like. Similarly, the rate of changes of the speed may be limited to the max/min acceleration/deceleration of that vehicle.

Following evaluation with at least one and more preferably a plurality of soft rules, the suspect vectors are scored. Optionally the score may be high if the number of appearances of that SV in that sampling window is high, for example. Optionally and preferably the score provides a measure with which suspect vectors may be evaluated. Most preferably the PID table is updated accordingly.

In some embodiments, optionally and preferably the score may reflect the percentages of number of messages that comply with that soft rule versus the total number of messages that associates with that SV. In other embodiments, the score may reflect the rationality of some of the values. The rationality may be defined by zones of values, zones of duration without changes, or the like. Finally the identification of that SV (the MID, the location of the segment of that SV and the length of that segment) with its score may be written 546 in the PID-candidate table of the relevant window.

Next in stages 550, 552 and 554 are utilized to determine if there are untested suspect vectors, vehicular parameters, and MID that need to be processed, so as to cover all options.

Figure 7:
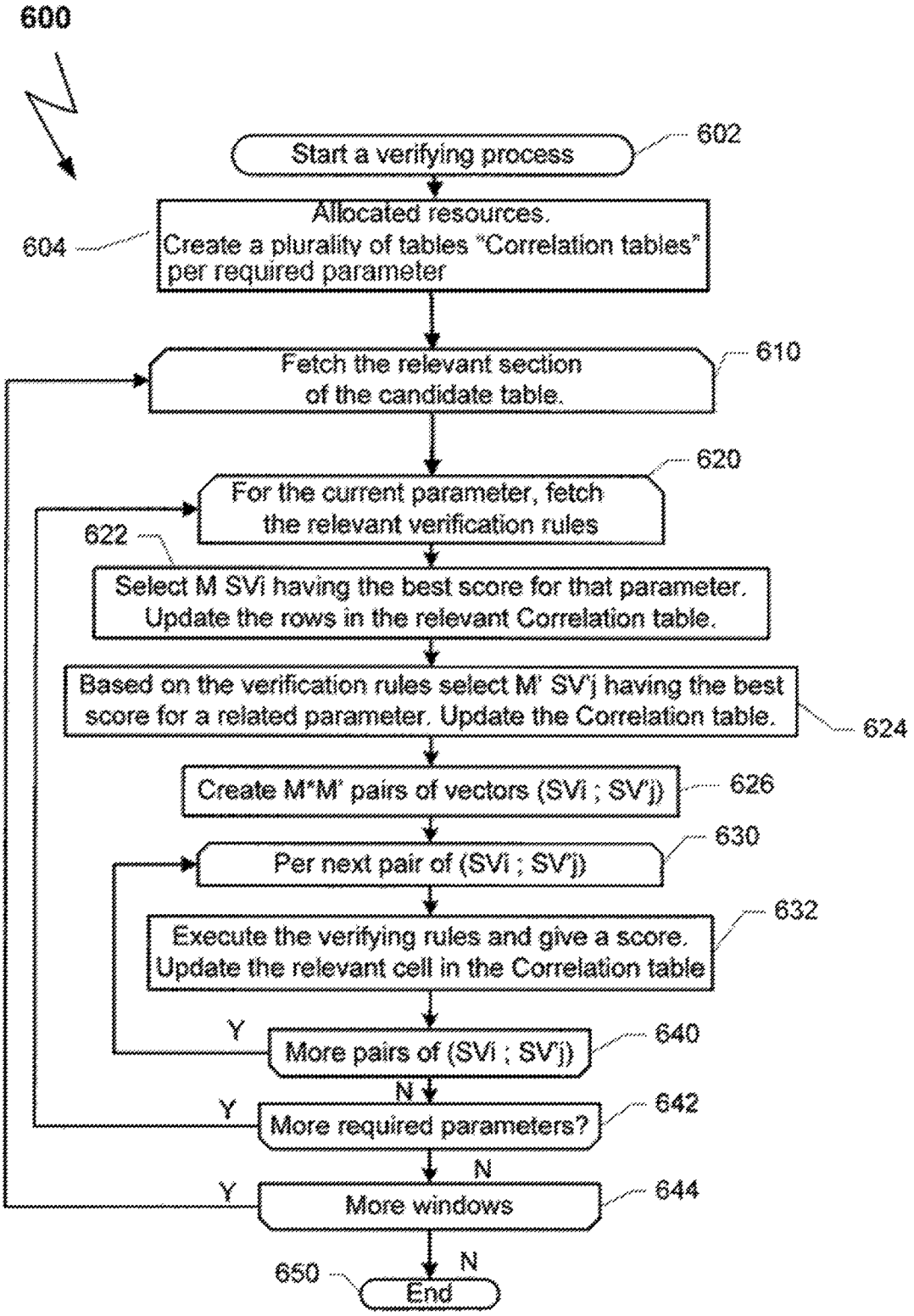
FIG. 7 is a flowchart illustrating a method according an optional embodiment of the present invention for verifying best candidates for a required parameter.

FIG. 7 illustrates a processor mediated method 600 for identifying and/or verifying the best candidates and/or suspect vectors for each vehicular parameter. Method 600 may be implemented by optional embodiments of VBR 60, optionally and preferably during the learning phase. Optionally and preferably method 600 may be implemented with MSPDV 340, and/or modeling module 70. Optionally and preferably the verification process is performed for individual vehicular parameter and therefore may be considered a fine filter following the coarse filter defined in method 500 previously described. Optionally all or a subset of suspect vectors may be processed according to the verification method 600.

Optionally a verification rule may be realized as the identification of a correlation between values of an suspect vector of one vehicular parameter with another vehicular parameter, for example odometer and speed, then each column may be associated with one of best candidate of the another required parameter.

Optionally a verification rule may examine the correlation between an event and a value of a suspect vector. For example the event may include entry into a fuel station and the suspect vector may be fuel volume level.

First in stage 602 the method is initiated by managing processor 370 and/or controller module 62.

Next in stage 604 the computational resources for example comprising memory resources are allocated by processor 370, 62. Optionally at least one or more correlation table may be allocated in order to evaluate the suspect vectors, most preferably based on the verification rules utilized. Optionally and preferably the verification table comprises rows of suspect vectors and columns comprise vehicular parameter and the score allocated in method 500.

Next in stage 610 the appropriate suspect vectors and/or candidates are loaded from the PID table.

Next in stage 620 the relevant verification rules for the current parameter may be fetched from the shared memory 330, 64.

Next in stage 622, the relevant section of the PID-candidate table may be examined looking for a group of M suspected vectors (SVi) having the highest score for that vehicular parameters. In some cases M may include all the SVs, which are stored in the "PID-candidate table". Those SVi are written in the rows of a correlation table.

Next in stage 624 each of the fetched verification rules of the current required parameter and/or the relevant correlation condition may be defined in stage 624. The correlation condition may be the other parameter and/or event that is used for calculating the correlation.

For example, if the condition is correlation between two vehicular parameters then a group of M' suspected vectors SV'j, having the best score for that another required parameter, may be selected 624. The value of M may be different from the value of M'. Both values may be in the range of five to ten SVs.

In some embodiments M and M' may include all the SVs, which are stored in the PID-candidate tables of both SVs. Those SV'j may be written in the columns of the correlation table. For a condition that is an event, each column represents the event. The score in the cell of a certain SVi with an event may reflect the correlation between the existences of the event in the time for each one of the massages that belong to that SVi. In case that two or more verification rules may be used then each cell may have a plurality of fields and each field may be associated with a verification rule.

Next in stage 626, a group of M multiple by M' pairs of vectors (SVi; SV'j) may be created.

Next in stage 630 the values of each of the SV of the current pair may be fetched and a correlation between the temporal behaviors of the values of the two SV may be determined to evaluate the correlation between them.

Next in stage 632 evaluate the correlation between the pairs of suspect vectors. Optionally the result may be written in the cell in the junction of SVi and SV'j.

Optionally where some parameters have more than one verification rule, each verification rule may be executed and tested.

For example, the correlation between the values of an SV for an odometer and the values of a suspected SV'j of speed may be calculated first and be written, next the correlation between the values of the SVi for the odometer and the values of an SV'j of the fuel tank may be calculated and be written. In some embodiments the correlation between the values of an SVi for speed and the values of a suspected SV'j of odometer may be calculated and be written in the correlation table, next the correlation between the values of the SVi for speed and the state of an accelerometer 345 may be determined and written in the correlation table. Optionally the correlation may be in any form for example including but not limited to constant, increasing, decreasing, variable, the like, or any combination thereof.

For example, the value that may be written in a field in the cell at the junction between an SVi of a suspected PID for speed and the state of the accelerometer (positive, zero, negative) may reflect the correlation between acceleration (positive) and increasing in the values of consecutive SVi; between no acceleration (zero) and constant speed or standing; and deceleration (negative) while decreasing in the values of consecutive SVi. Another example may be the value of the correlation that may be written in a field in a cell at the junction between an SVi of a suspected PID for the fuel tank and the state of "In a fuel station premises" (true; false). This value may reflect fast increasing in the values of consecutive SVi while the value of "In fuel station premises" is true. Or slow monitoring decreasing in the values of consecutive SVi when the value of "In a fuel station premises" is false.

After writing the one or more correlation values at the fields of the cell at the junction between SVi and SV'j, a decision may be made 640 whether additional pairs of (SVi;SV'J) exist. If yes, then process 600 returns to block 630 and select the next pair. If 640 there are no more pairs, then at block 642 a decision is made whether additional required parameter exist, if yes process 600 returns to block 620 and fetches the relevant verification rules for the next required parameter.

If 642 there are no additional required parameter, then at block 644 a decision is made whether additional sampling windows exist. If yes, process 600 returns to block 610 and fetches the section of the candidate table that is relevant to the next sampling window. If 644 there are no additional windows, then process 600 may be terminated, informing the managing processor 370 (FIG. 3) that the verification process 600 is terminated.

Figure 8:
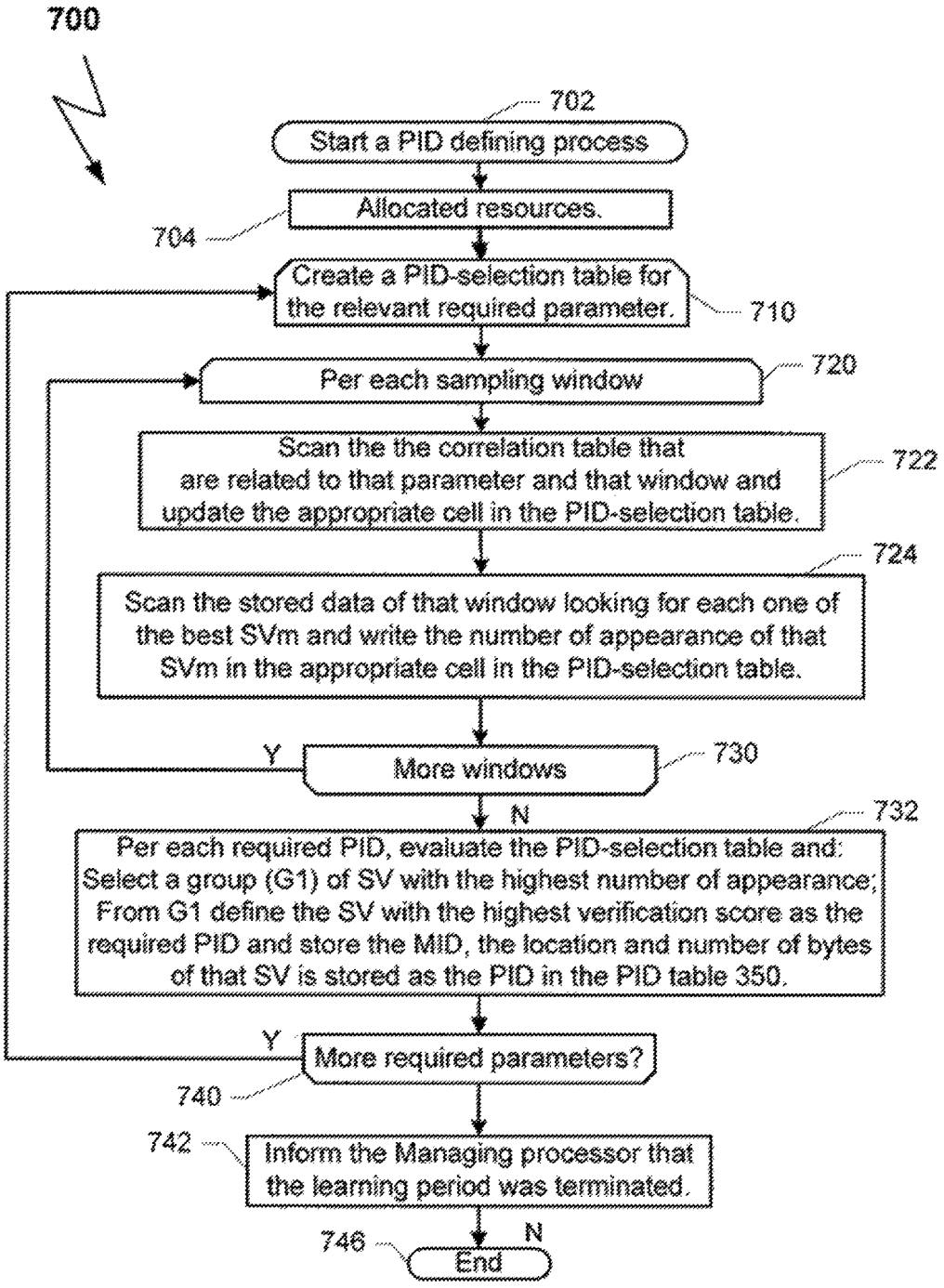
FIG. 8 is a flowchart illustrating a method according an optional embodiment of the present invention for defining the PID of a required a required parameter.

Referring now to FIG. 8 that illustrates a flowchart of a processor mediated method 700 for defining the PID of each vehicular parameter based on the processing of the suspect vectors and/or candidates. Optionally and preferably the PID may comprise the relevant MID, the offset in bits from the beginning of the payload 14 of that message 10, the number of bytes of that parameter, the scale, and the MSB and LSB locations.

Optionally and preferably method 700 may be implemented by an optional MSPDV 340 and/or modeling module 70, following or at the end of the learning period for a particular vehicular parameter. Most preferably method 700 provides for identifying the defining features of a vehicular parameter that may be obtained from a data structure 10 sniffed from vehicle data bus 52 without interrogating the vehicle processor 54.

First in stage 702 the PID defining process is initiate by managing processor 370, 62. Optionally the timing of may be based on elapsed time from the beginning of the learning period. Optionally the onset of stage 702 may be determined based on the quantity of data structures sniffed from vehicle data bus 52.

Next in state 704 the computing resources as well as storage resources are allocated, most preferably for individual vehicular parameter.

Storage resources for storing a plurality of PID-selection tables may be allocated. The plurality of PID-selection tables may be used during the execution of process 700. Each PID-selection table may be associated with a required parameter. Each row may be associated with one of few best SVn of that required parameter and each column may be associated with a sampling window. Each cell in the junction between a best SVn and a sampling window may have a plurality of fields, one of the field may store the number of appearance of that SVn in that window and the other fields may the one or more scores the SVn received in the verification process for that sampling window.

Next in stage block 710, a PID-selection table for the current vehicular parameter is generated per sampling window.

Next in stage 722 a first sampling window the relevant correlation table is scanned in search for the suspect vectors having the highest correlation score. Most preferably the selected suspect vectors are written in the rows of the PID-selection table, the score of the correlation of each one of them in each of the verification rules. In case that a certain SVm appears in one or more previous windows then just the one or more correlation scores may be written in the fields of the appropriate cell. If a certain SVm appears in that window for the first time, a new row in the table may be allocated for that SVm.

Then, the stored messages of that sampling window may be scanned looking 724 for the number of appearance of each of the SVm in that sampling window. The number of appearance of that SVm in that window may be written 724 in a field in the cell at the junction of SVm and that window.

Next a decision is made 730 whether additional sampling window exists. If yes, process 700 returns to block 720 for processing the information related to the next window. If 730 there are no additional sampling windows to process, then the PID-selection table of the current required parameter may be evaluated 732. In an example embodiments of process 700 a group (G1) of the SVm with the highest number of appearance among all the sampling window may be selected 732, the rest of the SVm that are less frequent may be filtered.

A statistical evaluation may be implemented 732 over the remained SVm, which belong to G1, over the plurality of the sampling windows. The statistical evaluation may comprise calculating an average score of each of the verification rule over the plurality of windows and per each SVm. Other embodiments may use other statistical parameter such as minimum, maximum, mean, median, variance, standard deviation, Gaussian distribution, distribution, variance, higher statistical moments, division, the like or any combination thereof. The SVm that has the highest values may be selected 732 as the PID of the required parameter. The selected PID may be referred by MID of the message that includes that SVm, the offset in bites from the beginning of the message or the payload of that message, the number of bytes of the segment that includes the parameter, the location of the MSB and LSB as well as the scale factor. This information may be written in the PID table 350 in association with the required parameter.

At block 740 a decision may be made whether additional required parameters exist. If yes process 700 returns to block 710 for processing the data for the next required parameter. If 740 there are no additional required parameters, an indication may be sent 742 to the managing processor informing it that the learning period terminated and the ongoing mode may be initiated.

Figure 9:
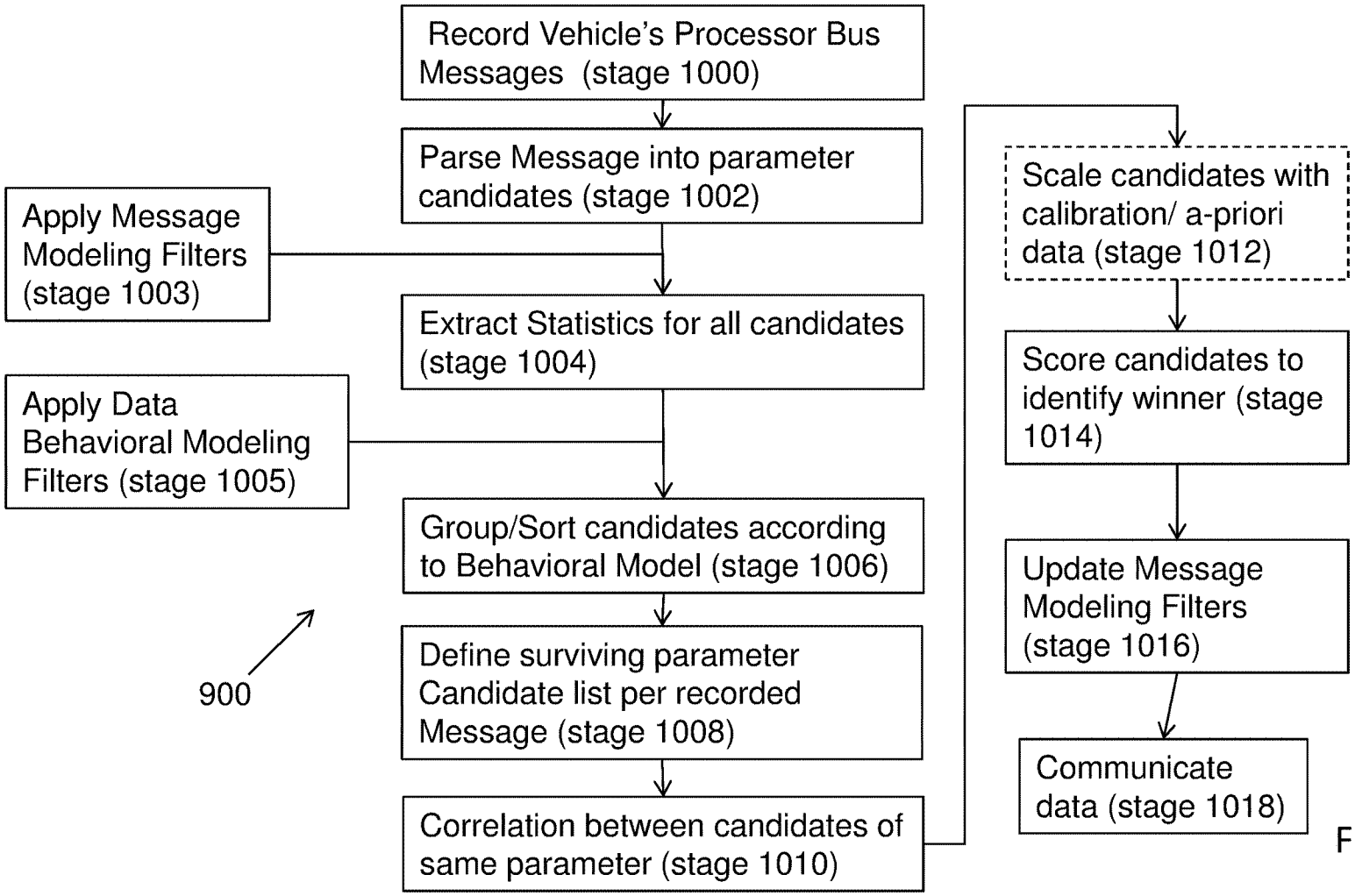
FIG. 9 is a flowchart illustrating a method according an optional embodiment of the present invention for identifying candidate parameters from a vehicle data bus message.

FIG. 9 is a flowchart illustrating a method according an optional embodiment of the present invention for identifying candidate parameters from a vehicle data bus data structure such as message 10 shown in FIG. 1, where no identifying features of the data structure is necessarily known. Most preferably method 900 provides for identifying the details of the data structure communicated over VB 52 for example to identify MSB position, LSB position, reading frames, BigEndian, LittleEndian, MiddleEndian, data prefixes, bit length, number of bytes, encryption codes, data sequence order, the like or any combination thereof.

First in stage 1000 data communicated over vehicle data bus 52, for example data structures in the form of messages 10 are recorded by VBR 60, for example with capture module 68.

Next in stage 1002 the data structure 10, and in particular payload 14, is parsed to define a plurality of parameter candidates. Optionally parameter candidates comprise various optional combinations of data structures formed from a data structure 10 and/or payload 14. Optionally and most preferably if communication over data bus 52 is provided in the form of message 10 as depicted in FIG. 1 most preferably parsing is implemented on payload 14 to define candidates and/or suspect vectors. Optionally each data structure may be utilized to abstract a plurality of candidates. Optionally individual candidates are abstracted by parsing data structure according to optional estimated values for individual data structure reading frame characteristics for example including but not limited message ID, MSB position, LSB position, reading frames, BigEndian, LittleEndian, MiddleEndian, data prefixes, bit length, number of bytes, bytes length, the like or any combination thereof. Preferably stage 1002 is mediated by processor 62. Optionally and most preferably an initial data parsing of data structure 10 may be provided according to message ID 12.

Next in stage 1003, available message modeling features are applied to the candidates defined in stage 1002, most preferably as an initial filtering stage to reduce the number of candidates. Optionally and preferably message modeling features may for example be identified by modeling module 70 and in particular message modeling module 74 as previously described. Optionally and preferably application of message module provides for removing any non-viable candidates abstracted in stage 1002.

Next in stage 1004, all candidates undergo statistical analysis based on the available data. Optionally statistical analysis may for example include but is not limited to determining minimum, maximum, mean, median, variance, standard deviation, Gaussian distribution, distribution, higher statistical moments, divisions, the like or any combination thereof.

Next in stage 1005 available Data Behavioral Modeling Filters are applied to the candidate set as a second filter and/or sorter. Data behavioral modeling filters may for example be defined and implemented by modeling module 70 particularly Parameter Data Modeling Module 72. Preferably this is utilized to filter for and identify candidates that feature data that resemble and/or are similar to known vehicular parameters data distribution and/or behavior, such as data resembling the temporal behavior of a vehicular parameter as depicted in FIG. 2A-C.

Next in stage 1006 candidates are sorted based on their affinity and/or proximity to a particular data behavioral model. Accordingly candidates are grouped into classes defined by their vehicular parameter proximity. For example, candidates that resemble data having distribution similar to that depicted in FIG. 2A, may be grouped as good candidates for vehicular parameter odometer.

Next in stage 1008, any candidates that cannot be grouped and/or statistically linked to vehicular parameter are removed from consideration. Optionally a single candidate may be a candidate for more than one and/or a plurality of vehicular parameters.

Next in stage 1010 the grouped candidates undergo correlation with one another to identify those candidate that most like one another. Optionally and preferably any candidates that do not exhibit correlation with other group members are deleted from further consideration.

Next in optional stage 1012 candidates may be scaled according to any calibration data and/or a-priori data available, for example as depicted in stage 1200 of FIG. 2D. For example, if a-priori data relating to initial odometer reading is available any candidates showing odometer reading that is lower than the initial odometer reading may be removed from consideration.

Next in stage 1014 candidates are scored and/or sorted to define winning and/or most probably candidates. Optionally and most preferably based on how closely they adhere to the data behavioral modeling of a vehicular parameter, as defined in module 70 particularly module 72.

Next in stage 1016, the data structure features associated with the winning candidates is examined to define the data structure features associated with the vehicular parameter identified by the candidate. Accordingly optionally and preferably, the data structure values relating to the reading frame characteristics for example including but not limited to message ID, MSB position, LSB position, reading frames, BigEndian, LittleEndian, MiddleEndian, data prefixes, bit length, number of bytes, bytes length, the like or any combination thereof, is recorded and utilized to define new message filter models in module 74 and to be applied in stage 1003 so that future candidates having similar features are identified quickly.

Finally in stage 1018 vehicular parameters identified by the surviving candidates and/or identified data structure filters are stored and/or communicated to a third party data processing system 80, as previously described.

Figure 10:
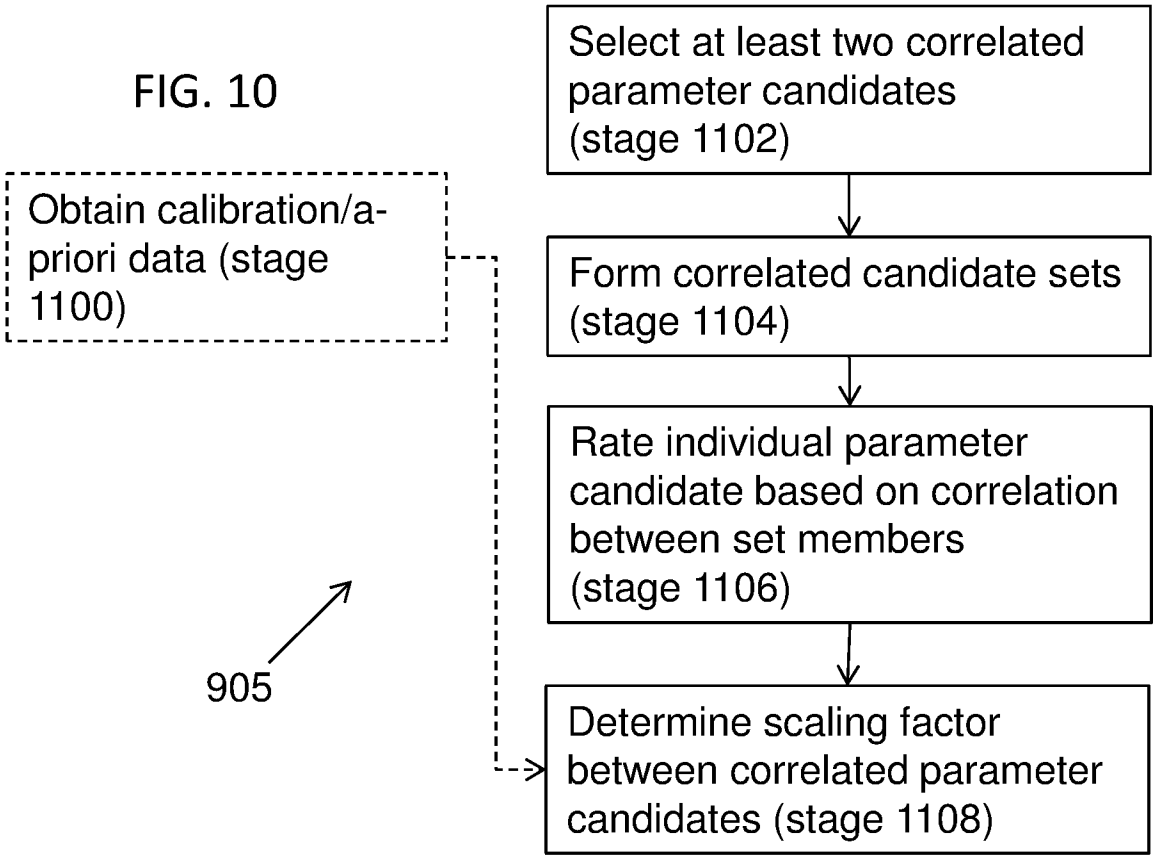
FIG. 10 is a flowchart illustrating a method according to an optional embodiment of the present invention for correlating and verifying the identification of vehicular parameters communicated from a vehicle data bus message.

FIG. 10 is a flowchart illustrating an optional processor mediated method 905 according an optional embodiment of the present invention. Method 905 is a further optional method filtering and identifying candidates provided by cross correlating and verifying the identification of vehicular parameters by cross correlated at least two candidates, that exhibit correlative relationship such as vehicle speed and odometer readings.

Optionally method 905 may be implemented as a part of stage 1010 and/or as an extension of stage 1010, depicted in FIG. 9.

First in stage 1102, identify at least two or more candidates for vehicular parameters that correlate and/or have a known correlation function with one another, for example odometer and speed.

Next in stage 1104, form a set of at least two or more correlating candidates.

Next in stage 1106 rate and/or score each member of the correlated data set based on the expected correlation function relative to the other data set members.

Next in stage 1108 identify any scaling factors and/or measures identified between the correlated data set members. Optionally stage 1108 may further utilize any available a-priori data and/or calibration data, from optional stage 1100, to determine any scaling factors. As previously described a priori data that may be made available, for example as depicted in stage 1200 of FIG. 2D. For example, if a-priori data relating to initial odometer reading is available any candidates showing odometer reading that is lower than the initial odometer reading may be removed from consideration.

While the above description describes a device, system and method that utilizes memory during the processing of data communicated over a vehicle data bus, without interrogating the vehicle processor, to identify vehicular parameters, however the use of such memory, for example SMMT, during the processing is optional. Embodiments of the present invention for computer mediated processing methods of data communicated over a vehicle data bus relating vehicular parameters may be performed without utilizing any member allowing the method to performed substantially in real time, for example as the vehicle's data bus is attained by way of sniffing without interrogating the vehicle processor.

While the invention has been described with respect to a limited number of embodiments, it will be appreciated that many variations, modifications and other applications of the invention may be made.

What is claimed is:

1. A method for identifying vehicular parameters of a vehicle by sniffing for data communicated over a vehicle data bus (52) characterized in that said vehicular parameters are identified without interrogating the vehicle's central processor (54), the method comprising:

a. sniffing to the vehicle data bus and recording data communicated thereon;

b. parsing said recorded vehicle bus data to form a plurality of vehicular parameter candidates;

c. performing a plurality of statistical measurements for each of said candidates to define said candidates' statistical behavior;

d. filtering said candidates according to a data behavioral model with at least one data behavioral modeling filter, wherein said data behavioral model is modeled to reflect the statistical behavior of known vehicular parameters, so as to associate each of said candidates with a vehicular parameter;

e. grouping and sorting said candidates according to said data behavioral model therein matching said candidates into groups representative of said vehicular parameters;

f. removing any of said candidates that are not matched and/or grouped to a vehicular parameter representative group;

g. performing a correlation analysis between said candidates that are grouped into a single vehicular parameter representative group, so as to determine a correlation coefficient;

h. scoring and sorting said candidates according to said correlation analysis; and i. selecting winning candidates according to said score to determine the vehicular parameter.

2. The method of claim 1 wherein said correlation analysis score is a function of the correlation coefficient.

3. The method of claim 2 wherein said winning candidate is selected based on a score wherein the threshold of the correlation coefficient has an absolute value of at least 0.75.

4. The method of claim 1 further comprising the step of determining the scale of said candidates based on available a-priori data of any vehicular parameter.

5. The method of claim 4 wherein said a-priori data is selected from the vehicular parameter representative group consisting of initial odometer reading.

6. The method of claim 1 wherein said statistical measurements are selected from the vehicular parameter representative group consisting of minimum, maximum, mean, median, average, standard deviation, variance, distribution analysis, Gaussian distribution, any combination thereof.

7. The method of claim 1 wherein parsing said recorded vehicle bus data comprises applying a data structure Filters provided to extract available data structure details selected from: MSB position, LSB position, reading frames, BigEndian, LittleEndian, MiddleEndian, data prefixes, bit length, number of bytes, encryption codes, data sequence order, or any combination thereof.

8. The method of claim 1 wherein recorded vehicle bus data is provided in the form of a message (10) having a message header (12) and payload (14), and wherein said message header comprises unique identifier in the form of a message ID (MID).

9. The method of claim 8 wherein said method is performed on said payload.

10. The method of claim 8 wherein said candidates are associated with said unique identifier message ID.

11. The method of claim 1 further comprising a cross correlation between at least two or more candidates from different vehicular parameter groups wherein said vehicular parameter are correlated and having a known correlation function, the method comprising:

j. Forming a cross correlation data set including at least two or more candidates;

k. Performing a cross-correlation analysis between said at least two or more candidates;

l. Determining a scaling factor for said at least two or more candidates based on said cross-correlation analysis.

12. The method of claim 11 further comprising obtaining a-priori data of any vehicular parameter.

13. The method of claim 12 wherein said a-priori data is selected from the vehicular parameter representative group consisting of initial odometer reading.

14. The method of claim 1 wherein said winning candidate is utilized to determine a scale of a parameter by comparison to a-priori data.

15. The method of claim 1 wherein said parsing is performed on a payload portion of said recorded vehicle bus data.

16. The method of claim 1 wherein said candidates are formed from a payload portion of said recorded vehicle bus data.

17. The method of claim 1 wherein said method is performed substantially simultaneously as data is communicated over the vehicle data is made available.

18. The method of claim 1 wherein said method is performed substantially without recording intermediate data.

19. A device adapted to be associated directly and/or indirectly with the vehicle data bus provided to implement the processor mediated method of claim 1, the device comprising, a processor module, a communication module, data capture module, and a data modeling module, characterized in that said data modelling module provides for statistically modeling vehicular parameter candidates based on known vehicular data historical data.

20. The device of claim 19 wherein said data modeling module comprises a message modeling module provided for modeling the data structure of data sniffed from the vehicle data bus.

21. A system for determining and analyzing vehicular parameters from a vehicle data bus characterized in that the system does not interrogate the vehicle processing unit, the system comprising a data management system (80) in communication with a vehicle bus reading (VBR) device (60) installed in a vehicle (50) wherein said VBR (60) is associated with said vehicle about said vehicle data bus (52), and wherein said VBR (60) provides for seamlessly ascertaining vehicular parameters from data communicated over said vehicle data bus (52) without interrogating the vehicle processor (54) by implementing the processor mediated method of claim 1.

22. The system of claim 21 wherein said data management system is a fleet management system.

23. The system of claim 21 wherein said data management system (80) communicates with said VBR (60) to define vehicular parameters of interest.

24. The system of claim 21 wherein said data management system (80) provide a-priori data that models the behavior of said vehicular parameters.

25. The system of claim 21 wherein said VBR (60) communicates to said data management system (80) any vehicular data ascertained from said vehicle data bus (52).

* * * * *